US010403093B1

(12) United States Patent
Halvorson

(10) Patent No.: US 10,403,093 B1
(45) Date of Patent: Sep. 3, 2019

(54) GAMING SYSTEM AND METHOD INCLUDING SYMBOL CONVERSIONS BASED ON SYMBOL STACKS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/151,107

(22) Filed: Oct. 3, 2018

(51) Int. Cl.
*G07F 17/32* (2006.01)
*G07F 17/34* (2006.01)
*G06Q 50/34* (2012.01)

(52) U.S. Cl.
CPC ..... *G07F 17/3267* (2013.01); *G06Q 50/34* (2013.01); *G07F 17/3211* (2013.01); *G07F 17/3258* (2013.01); *G07F 17/34* (2013.01); *G07F 17/3216* (2013.01)

(58) Field of Classification Search
CPC ..... G07F 17/3213; G07F 17/3216; G07F 17/3227; G07F 17/3262; G07F 17/3265; G07F 17/34
See application file for complete search history.

(56) References Cited

U.S. PATENT DOCUMENTS

| | | | | |
|---|---|---|---|---|
| 9,805,542 | B2 | 10/2017 | Rodgers et al. | |
| 2009/0117975 | A1* | 5/2009 | Yoshizawa | G07F 17/3265 463/20 |
| 2009/0227351 | A1* | 9/2009 | Yoshizawa | G07F 17/3244 463/20 |
| 2009/0233691 | A1* | 9/2009 | Yoshizawa | G07F 17/32 463/20 |
| 2010/0234089 | A1* | 9/2010 | Saffari | G07F 17/34 463/20 |
| 2013/0260863 | A1* | 10/2013 | Lee | G07F 17/34 463/20 |
| 2014/0274294 | A1* | 9/2014 | Baerlocher | G07F 17/34 463/20 |
| 2016/0027238 | A1* | 1/2016 | Zurawski | G07F 17/34 463/20 |
| 2016/0155290 | A1* | 6/2016 | Rodgers | G07F 17/3262 463/21 |

* cited by examiner

*Primary Examiner* — Justin L Myhr
(74) *Attorney, Agent, or Firm* — Resolute Legal PLLC

(57) ABSTRACT

Various implementations of a gaming system and method include generating and displaying a plurality of symbols, where at least some generated symbols are converted into different symbols when sandwiched between at least two columns containing the same or similar symbols. The gaming system may convert the sandwiched symbols into symbols that are the same or similar to the symbols in the at least two columns. The gaming system may evaluate the displayed symbols, including the converted sandwiched symbols, for winning symbol combinations and payout any determined awards.

20 Claims, 12 Drawing Sheets

GAMING SYSTEM AND METHOD INCLUDING SYMBOL CONVERSIONS BASED ON SYMBOL STACKS

FIELD OF THE DISCLOSURE

The present disclosure relates to gaming devices.

BACKGROUND

Gaming machines accept wagers from players in exchange for the opportunity to win awards or prizes. Current gaming machines use computing devices that control various technologies to provide specialized systems adapted to gain the attention of players and to keep them engaged with the gaming machines. To retain players' interest, gaming machines that offer new and unconventional functionality are needed.

SUMMARY

Various implementations of a gaming system and method include generating and displaying a plurality of symbols, where at least some generated symbols are converted into different symbols when sandwiched between at least two columns containing the same or similar symbols. The gaming system may convert the sandwiched symbols into symbols that are the same or similar to the symbols in the at least two columns. The gaming system may evaluate the displayed symbols, including the converted sandwiched symbols, for winning symbol combinations and payout any determined awards.

In some implementations, the gaming system includes symbol display areas associated with video-based slot machine reels (also herein referred to as "reels"). For example, the gaming system may include five reels that are each associated with three symbol display areas. The gaming system may further include a symbol set that provides symbols associated with each reel. Further, the gaming machine may include pay lines corresponding to various combinations of symbol display areas. For example, the pay lines may cross the symbol display areas horizontally, vertically, and diagonally. A player may selectively activate one or more of the pay lines by placing wagers on such pay lines. For example, selecting a minimum wager amount may activate only one pay line, selecting additional wager amounts may activate additional pay lines, and selecting a maximum wager amount may activate all pay lines.

For a play of a game, the gaming system may generate symbols from the associated symbol sets for the symbol display areas of the reels. In some implementations, the gaming system evaluates the generated symbols to determine whether at least two of the reels include stacked symbols. In some implementations, a reel with stacked symbols is a reel with the same or similar symbols displayed in adjacent symbol display areas on the reel. In some implementations, when the gaming system determines that at least two of the reels include stacked symbols, the gaming system determines whether at least one reel is sandwiched between the two reels including stacked symbols. The gaming system may convert at least one of the symbols on the at least one reel that is sandwiched between the two reels including stacked symbols. In some implementations, the gaming system converts the at least one of the symbols on the at least one reel that is sandwiched between the two reels including stacked symbols into symbols that are the same or similar to the stacked symbols. In some implementations, the conversion creates stacked symbols on the at least one reel that is sandwiched between the two reels including stacked symbols.

The gaming system may evaluate the displayed symbols (including the converted symbols) to identify winning symbol combinations and determine a payout amount based on the winning symbol combinations along wagered pay lines.

In some implementations, the gaming system may also determine if a bonus game should be triggered. In some implementations, the gaming system determines whether a mystery bonus controller outputs a bonus game triggering signal. In alternative implementations, the gaming system may evaluate the displayed symbols for symbol combinations that trigger a bonus game. In some implementations, at least one symbol from the symbol sets are designated as a triggering symbol. When the gaming system determines that a predetermined quantity of triggering symbols are generated, the gaming system may activate a bonus game. Upon triggering a bonus game, the gaming system may execute the bonus game, evaluate the bonus game, and issue the player any award determined for the bonus game.

As described above and set forth in greater detail below, gaming systems in accordance with aspects of the present disclosure provide a specialized computing device including non-conventional hardware and software that improve upon the existing technology of human-computer interfaces by providing functionality of generating display outputs that enable players to convert symbols and generate new awards. Doing so improves the operation of the gaming machines for their specialized purpose by reducing player disappointment with game outcomes and enhancing player excitement for a play of a game.

DETAILED DESCRIPTION

Figure 1:
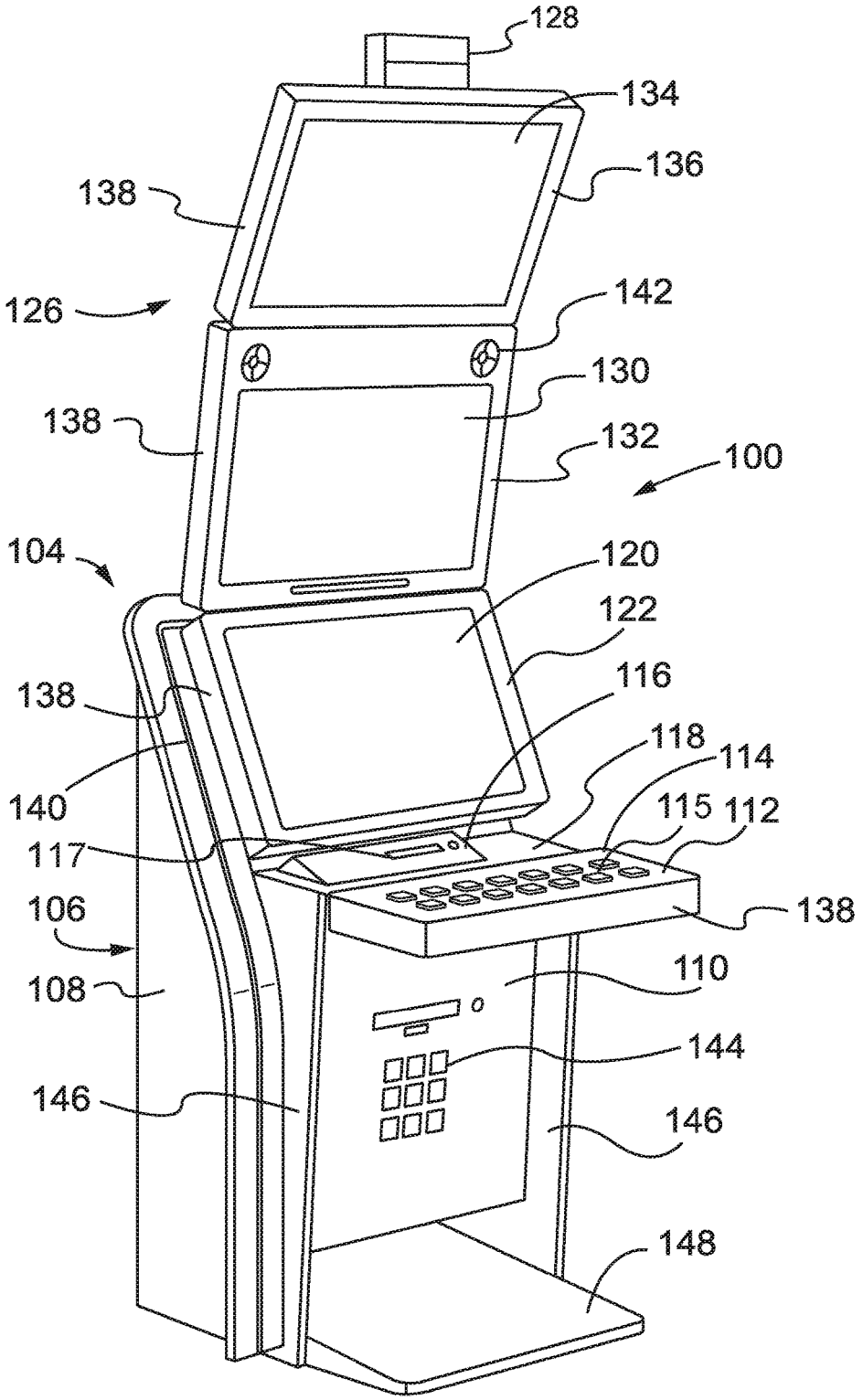
FIG. 1 shows a perspective view illustrating an example gaming device in accordance with aspects of the present disclosure.

Various implementations of gaming systems and methods consistent with the present disclosure include generating and displaying a plurality of symbols, where at least some generated symbols are converted into different symbols when sandwiched between at least two columns containing the same or similar symbols. The gaming system may convert the sandwiched symbols into symbols that are the same or similar to the symbols in the at least two columns. The gaming system may evaluate the displayed symbols, including the converted sandwiched symbols, for winning symbol combinations and payout any determined awards.

In some implementations, a gaming system includes a cabinet, a processor, a display device supported by the cabinet, an input device supported by the cabinet, a value acceptor supported by the cabinet, a value dispenser supported by the cabinet, and a memory device that stores a program instructions. The program instructions, when executed by the processor, control the gaming device to perform operations including establishing a credit balance based at least in part on a monetary value received by the value acceptor. The operations can also include placing a wager following receipt of a wager input via an input device, the credit balance being decreased by the wager. The operations can also include randomly generating symbols from symbol sets and displaying, on the display device, the symbols in a number of symbol display areas, where the symbol display areas are arranged in columns of symbol display areas. The operations can include determining whether at least two of the columns each include stacked symbols, where stacked symbols include at least two of a same symbol in adjacent symbol display areas of such columns. The operations can include determining whether at least one of the columns is a sandwiched column, where the sandwiched column comprises a column that is sandwiched between the at least two of the columns that include stacked symbols. The operations can include converting, into a different symbol, at least one symbol in the sandwiched column and displaying, on the display device, the different symbol. The operations can include evaluating the symbols that remain displayed and the different symbol for winning symbol combinations. The operations can further include displaying, on the display device, an award based on any winning symbol combinations, the credit balance being increased by the award, and issuing value from the value dispenser based on the credit balance upon receipt of a cash out signal via the input device.

Gaming Device Platform

The features and advantages of the gaming system and method described herein may be provided to a player via a gaming device platform that includes various structures and components for allowing player interaction with the gaming device. While only one gaming device platform will be described in detail herein, it is understood that the features, objects, and advantages of the gaming system described herein may be implemented in one or more alternative gaming device platforms.

FIG. 1 shows a perspective view illustrating an example of gaming system 100 in accordance with aspects of the present disclosure. Such gaming system 100 may be referred to as a slot machine and, as illustrated, is housed in a cabinet 104 (e.g., a housing) constructed so that a player can operate and play the gaming system 100 while standing or sitting. The cabinet 104 can include a lower cabinet body portion 106, which includes a pair of cabinet side panels 108 (only one of which is viewable in the perspective view of FIG. 1), a front panel 110, and a rear panel (not shown). Additionally, a base panel (not shown) and a top panel surface (not shown) may support a first game display device 120 and the player interaction area 112. The cabinet panels 104, 106, 108, 110 (as well as the base panel and the top panel surface) may be interconnected along their edges and cooperate to form the cabinet 104, which encloses and houses components of the gaming system 100, as can be seen in FIG. 1. The cabinet 104 may function to securely protect local control system, technology components, and provide support for game display(s) and player input and output interactions with the gaming system 100, such as describe herein below.

While the example cabinet 104 is depicted as having a particular shape, structure, and organization, it should be appreciated that a wide variety of cabinet enclosure sizes, shapes, and designs are possible for the gaming system 100. For example, the cabinet panels 104, 106, 108, 110 (as well as the base panel and the top panel surface) may be combined into fewer elements or divided into additional elements. Additionally, the positions of the displays (e.g., first display device 120) and input/output devices can be reorganized and/or relocated with respect to one another.

In accordance with aspects of the present disclosure, a player can interact with the gaming system 100 in various ways to direct the wagering and game play activities and preferences. More specifically, the cabinet 104 includes input and output areas generally designated as the player interaction area 112. The player interaction area 112 may be located on the front top side of cabinet 104 and, as shown, on a panel structure that extends outwardly from the gaming system 100 in a player's direction. The player interaction area 112 may contain player input and output structures, including a player control area 114, a player value acceptor and dispenser area 116, and player convenience input area 118.

The player control area 114 includes one or more input devices 115, such as buttons and touch sensitive areas, through with which players may interact with the gaming system 100 so as to direct game play. It is expected that the cabinet 104 provides an easily accessible location and support for player input/output (I/O) interactions with the gaming system 100, including gaming control interactions and value wagering interactions. Although the gaming system 100 illustrated in FIG. 1 shows the input devices 115 of the player control area 114 as physical controls (e.g., buttons), it is understood that in some implementations, a player's gaming control interactions could be made by either the physical controls or functionally equivalent "soft" controls (e.g., soft buttons) located on the gaming display and activated by player touch (e.g., touch screen interfaces), or a combination of both arrangements.

The input devices 115 may include the following: game selection button(s) in any implementation where more than one game is provided in a single gaming system 100; gaming denomination value selection button(s) in any implementations where one or more wagering denomination value is accommodated; wager selection button(s) for the player to indicate or select the desired wager value for a game in any implementations where a selection of wager values are offered; pay line selection button(s) for selecting the number of active pay lines in game implementations that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information.

The player value acceptor and dispenser area 116 may include one or more value acceptance and value distribution devices 117 that allow the player to interact with the gaming system 100 and to risk or otherwise place a wager (a monetary value) on one or more outcomes of a game. The value acceptance and value distribution devices 117 may return winnings to the player via some form of value distribution. In the player value acceptor and dispenser area 116, a player can supply monetary value to the gaming system 100 via the value acceptance and value distribution devices 117. In some implementations, the value acceptance and value distribution devices 117 may accept any one or more of the following from a player to establish a gaming credit balance: coins, bills, tokens, tickets/vouchers, player ID cards, credit cards, or other suitable forms of value. Thus, if the gaming system 100 accepts coins and bill, the value acceptance and value distribution devices 117 may comprise a currency bill validator and a coin validator. Likewise, if the gaming system 100 accepts tickets, the value acceptance and value distribution devices 117 may comprise a ticket acceptor that receives tickets or vouchers representing some monetary value. The ticket acceptor may include a bar code reader, or other appropriate code reader, for reading the encoded value contained by the player's ticket or voucher. In some implementations, value acceptance and value distribution devices 117 can accept more than one type of value. In some implementations, the player value acceptor and dispenser area 116 may include multiple different value acceptance and value distribution devices 117 that accept different types of value from players.

Upon receipt of some type of value from the player, the value acceptance and value distribution devices 117 of the player value acceptor and dispenser area 116 can perform validation on the player supplied value using appropriate hardware readers (e.g., determining that the currency bills/coins/tokens are genuine or the ticket/voucher is genuine). If the validation result is positive on player supplied value, the value acceptance and value distribution devices 117 can generate a signal to a processor of the gaming system 100 that establishes a gaming credit balance for playing one or more games on gaming system 100.

In some implementations, the value acceptance and value distribution devices 117 dispenses a monetary value, or a representation thereof, from the gaming system 100 when a player chooses to "cash out" the gaming credit balance (e.g., remove value from the gaming system 100). The player can cash out at any suitable time. When a player cashes out the value contained on a credit meter (not shown) of gaming system 100, a processor of gaming system 100 may cause a printer included in the value acceptance and value distribution devices 117 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming system 100 may cause a currency bill dispenser or a coin dispenser included in the value acceptance and value distribution devices 117 to dispense the value contained on the credit meter of gaming system 100.

Various combinations of the above value acceptance and value distribution arrangements are possible. The gaming system 100 may include other value acceptance and value distribution mechanisms in the player value acceptor and dispenser area 116. For example, the value acceptance and value distribution devices 117 may include a magnetic strip or chip card reader/writer in order to accept value from and transfer value to a magnetic strip or an embedded chip card. In other implementations, the value acceptance and value distribution devices 117 may include hardware for transferring (and receiving) non-traditional currencies to players such as digital currencies (e.g., bitcoin).

In some implementations, the value acceptance and value distribution devices 117 may include a card reader that accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming system 100 may be associated with the player account. Additionally, a numeric or alphanumeric keypad (not shown) may be provided adjacent to the card reader slot that enables player entry of a personal identification number or the like for secure access to card information.

In some implementations, a player convenience input area 118 may be included in the gaming system 100, as is shown in FIG. 1. In various implementations, player convenience input area 118 may have a variety of features and functions depending on the jurisdictional deployment of the gaming system 100. In some implementations, the player convenience input area 118 may house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into the gaming system 100 during play. These player loyalty/player tracking cards may be associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain implementations, the player convenience input area 118 may include player convenience features such as a pocket for storage that allows players to store their personal items such as a mobile phone. The gaming system 100 may include one or more universal serial bus (USB) ports that enables a player to charge their electronics or connect to services such as the Internet or food service. Further, player convenience input area 118 of the gaming system 100 may include buttons to request food or drink service if the gaming device is located in an establishment that has food and drink service. The gaming system 100 may be connected to a local or wide area network such that selection of the requested food or drink service may alert the establishment's hospitality staff to deliver the requested service directly to the gaming system 100.

The layout of the player control area 114, player value acceptor and dispenser area 116, and the player convenience input area 118 in gaming system 100 may be arranged differently than those disclosed and illustrated herein. The selections and arrangement of input locations on the cabinet 104 may be dependent upon the game buttons, the type of value wagered, and the player conveniences utilized in the deployment configuration of gaming system 100.

With continuing reference to FIG. 1, in some implementations, the lower cabinet body portion 106 includes the first game display device 120, which can be mounted atop or flush with a top panel surface of the lower cabinet body portion 106. The first game display device 120 can be, for example, a 27-inch liquid crystal display (LCD) display mounted in a widescreen orientation. However, any suitable display may be used in any suitable orientation. In the illustrated implementation, the first game display device 120 can mounted within and framed by first display frame 122 which is, in turn, mounted upon lower cabinet body portion's top panel surface. In this manner, the first game display device 120 is both surrounded and secured within the first display frame 122 and raised above the cabinet's top panel surface. Additional features of the first display frame 122 are described below. In some implementations, the gaming system 100 may use a single first game display device 120 and not include additional game displays (not illustrated). For example, a single first game display 120 may span the one or more portions of the cabinet 104 (e.g., lower body cabinet portion 106 and upper body cabinet body portion 126, described below) in place of other display devices (e.g., display devices 130 and 134, described below).

The lower cabinet body portion 106 can be further constructed to support an upper cabinet portion 126. The upper cabinet portion 126 may be comprised of an upwardly extending support structure (not illustrated) that extends upwardly from the rear side of lower cabinet body portion 106 configured to mechanically support one or more additional game displays.

At the topmost end of the support structure, a cabinet top light 128 may be provided. The cabinet top light 128 is capable of illumination in a variety of colors and is utilized to indicate and communicate conditions of the gaming system 100 to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In some implementations, as illustrated in FIG. 1, gaming system 100 includes additional displays, including a second game display device 130 and a third game display device 134. The second game display device 130 and the third game display device 134 can be disposed generally in a vertical relationship and generally in alignment with the first game display device 120. Like the first game display device 120, the second game display device 130 and the third game display device 134 can be 27-inch LCD displays and can be mounted in a widescreen orientation in some implementations. However, any suitable display in any suitable orientation may be used for the second game display device 130 and the third game display device 134. Further, like the first game display device 120, the second game display device 130 and the third game display device 134 can be mounted within and framed by second display frame 132 and third display frame 136, respectively. The second display frame 132 and the third display frame 136 can be attached to the upper cabinet support structure and can protect the second game display device 130 and the third game display device 134.

The first game display device 120, the second game display device 130, and the third game display device 134 can be disposed at an angle from each other to form a player-facing concave arc. However, in some implementations, the angles between the displays 120, 130, and 134 may be adjustable and may be smaller or greater than the angles illustrated in FIG. 1. Further, it is understood that in some implementations the displays may be disposed in a common plane relative to each other.

It also should be appreciated that in various implementations a variety of display technologies may be utilized equivalently and interchangeably with a variety of implementations of the gaming device. Equivalent display devices include all variations of liquid crystal displays, light emitting diode displays, and plasma displays.

In some implementations, different sized displays may be combined to display gaming data on gaming system 100. As a non-limiting example, a 27-inch widescreen LCD display may be combined with a 20-inch portrait-oriented LCD or a light emitting diode (LED) display. This combination may be used, for example, with a third scrolling banner LED display. In alternative implementations, one, two, three, or more displays could be used in a variety of positions and orientations. Any suitable combination may be used. It should also be appreciated that a processor of gaming system 100 may communicate with the disclosed first game display device 120, second game display device 130, and third game display device 134 through a video card of gaming system 100 to produce the visible aspects of a game.

In some implementations, one or more of the first game display device 120, the second game display device 130, and the third game display device 134 may be fitted with a transparent touch sensitive overlay for sensing player touch inputs into the gaming system 100. The touch sensitive overlays can communicate with a processor of gaming system 100 to enable the player to interact with the game.

In some implementations, the curved displays may be used for any or all of the first game display device 120, the second game display device 130, or the third game display device 134. Similarly, any of the displays used for gaming system 100 can be based on flexible display technologies. For example, it is possible to utilize flexible display technologies to create uniquely shaped curving, wavy, or tubular display structures to provide one or more of the first game display device 120, the second game display device 130, and the third game display device 134. Additionally, in some implementations flexible display technologies can be used in combination with fixed flat screen technologies.

While the gaming system 100 has been described as implemented with video technologies, in some implementations, mechanical reels with reel strips containing game indicia and step motor controllers may be employed to provide game information to a player. In some implementations, the reel strips may include printed symbols. In another implementation, the mechanical reels may include flexible video display technology as the reel strips on mechanical reels. Thus, games implemented in video form can readily be implemented with mechanical reels utilizing such display technology. Alternatively, in other implementations mechanical reels with reels strips having fixed symbols displayed along the reel strip could be used to implement the game.

Dependent upon the particular gaming device housing style, a variety of other display technologies may be utilized in combination with the gaming device disclosed herein. For example, the gaming system 100 may have one or more display devices in addition to the main game display(s) in some implementations. For example, the gaming system 100 may include a player tracking device having a player tracking display which displays various information to the player regarding the player's status. The gaming system 100 may also include other game-related displays such as the wager display and the gaming credit balance display. These additional game-related displays may be separate display devices or may be displayed on any one or more of the first game display device 120, the second game display device 130, or the third game display device 134.

The gaming system 100 may also include cabinet lighting design functions to attract players. In the example gaming system 100 illustrated in FIG. 1, attractive cabinet lighting is provided by frame accent lighting 138. It is noted that frame accent lighting 138 is a common structure found on the first display frame 122, the second display frame 132, and the third display frame 136 and player interaction area 112. Example areas where frame accent lighting is applied to the gaming system 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In some implementations, the circuit boards are flexible circuit boards. These LED strips and transparent or translucent coverings may surround one or more gaming device displays frames, as well as the player interaction area, to highlight these areas.

In some implementations, the individual LEDs mounted on the LED strips are of a type that can emit red, green, and blue light. In an alternative implementation, separate LEDs are used for the light colors. All LED strips can be electrically connected and can be controlled by a cabinet lighting controller (e.g., cabinet lighting controller 218 in FIG. 2) in conjunction with a processor of the gaming system 100 to selectively mix the emitted light colors in a manner to create any color. The cabinet lighting controller can flash and vary lighting as desired. For example, cabinet edge lighting can change and flash in combination with music rhythms or in combination with game events. Other variations are possible.

In some implementations, cabinet 104 may include LED strip lighting or LED rope lighting to accentuate the cabinet and enhance the attractiveness of the gaming system 100 to players. LED rope lighting is a number of small light-emitting diode bulbs linked together and encased in a plastic, polyvinylchloride, or other suitable material to create a string of lights. For example, in one implementation illustrated in FIG. 1, cabinet 104 includes cabinet accent lighting 140. In some implementations, cabinet accent lighting 140 is LED rope lighting mounted flush with the front side edge of the cabinet side panels 108. The LED rope lighting can generate any of suitable colors, and are controlled by cabinet lighting controller and a processor of gaming system 100 to selectively mix the emitted light colors in a manner to create any color in the same manner as the frame edge lighting.

In various implementations, gaming system 100 includes one or more audio speakers 142 and appropriate driving electronics and sound cards so that game players may experience pleasing audio aspects of the gaming system 100. Audio is desirable to attract and maintain player interest in gaming system 100. The gaming system 100 may also emit attraction sounds during any idle period of gaming system 100. Game audio may add to the player's enjoyment of gaming system 100 by providing music and sound effects designed to enhance and compliment the gaming experience. In FIG. 1, the audio speakers 142 are shown mounted on the upper corners of second display frame 132. Any suitable number of additional speakers 142 may be provided on additional display frames or on the lower cabinet body portion 106 as desired.

The speakers 142 designed for emitting bass vibrations may be included in some implementations. Placement of the speakers 142 may be selected to enhance the sound emitting characteristics of the gaming system 100. For example, bass speakers or additional speakers 144 may be mounted inside lower cabinet body portion 106. Further, it is envisioned that in some implementations sound processing such as multi-channel processing and surround sound processing are included in gaming system 100. Audio jacks for attachment of player headphones may also be provided in some implementations of gaming system 100 for the player to further enhance the audio experience of the game and also to block out noise from other gaming devices.

In some implementations, the front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing the gaming system 100 in a seated position. Foot rest 148, which may be cushioned, is provided below player interaction area 112 to enhance a player's ergonomic comfort while playing the gaming system 100. In some implementations, the edges of player interaction area 112 may be ergonomically cushioned as well.

The gaming system 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary, and/or 3) provide an easy location and support for all necessary player input/output (I/O) interactions, including gaming control interactions and value wagering interactions. For example, in some implementations the gaming system 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In some implementations, housing styles of cabinet 104 of gaming system 100 may include bar top or table top housing arrangements. These housings are generally small enough to be placed on top of an existing bar or table while providing the requisite gaming device housing functions of protection of/access to gaming electronics, displays, and player I/O functions described above.

In some implementations, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
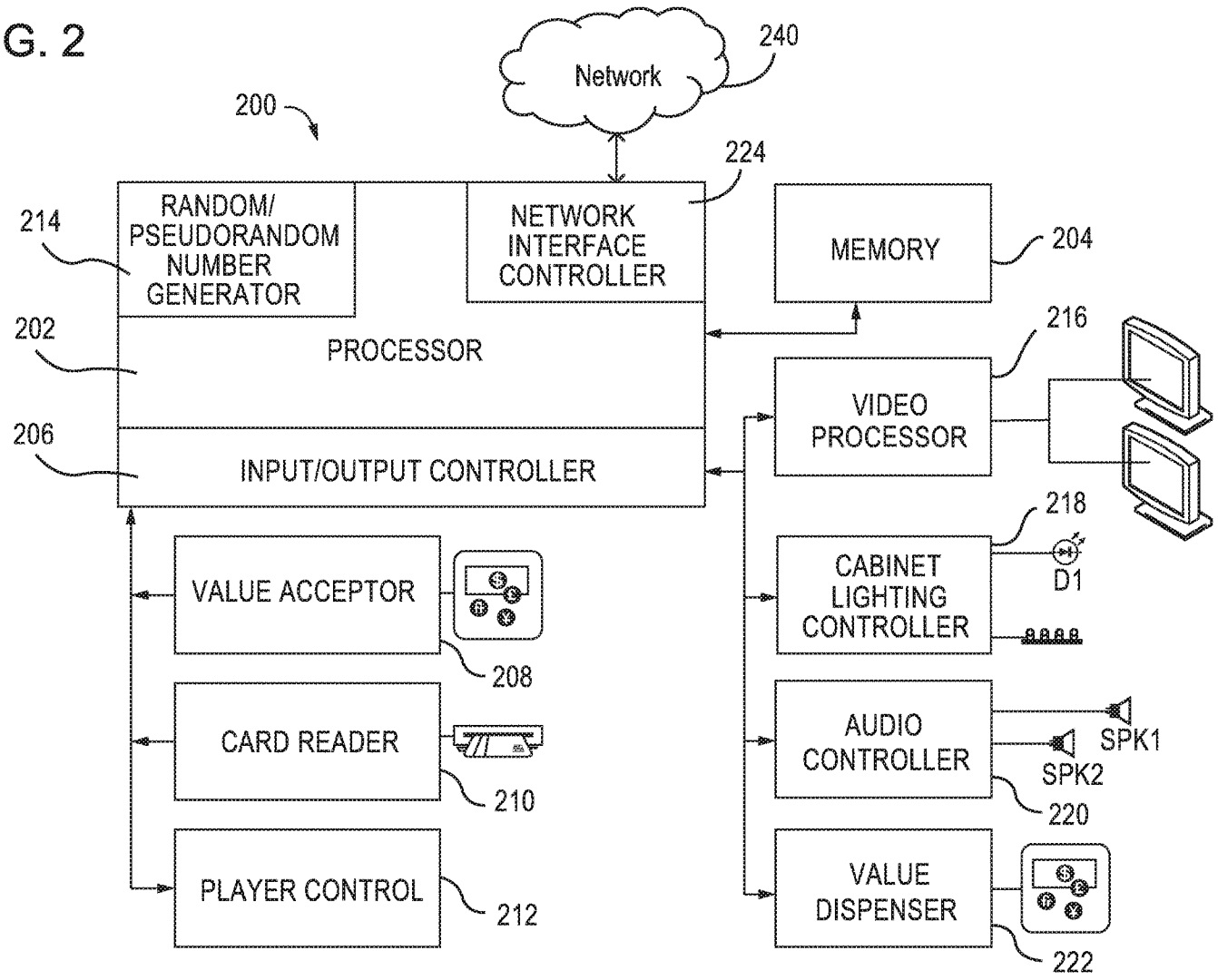
FIG. 2 shows a functional block diagram illustrating a gaming system in accordance with aspects of the present disclosure.

FIG. 2 illustrates a functional block diagram of a control unit 200 of a gaming system (e.g., gaming system 100) configured to perform specialized game functions and operations, consistent with the embodiments described herein. The functional elements shown in FIG. 2 cooperate, on a broad and general level, to function as a gaming system. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In accordance with aspects of the present disclosure, the control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one implementation, the control unit 200 is also configured to communicate with a server device through a network.

In some implementations, the control unit 200 includes at least one processor 202 (e.g., a central processing unit (CPU)). In some implementations, the processor 202 is specially configured with arithmetic logic units and math co-processors, also known as floating point units, for performing the gaming consistent with the various implementations disclosed herein. In some implementations, the specially configured processor 202 includes registers for holding instructions or other data, and cache memory for storing data for faster operation thereupon. In some implementations, the specially configured processor 202 may be a multi-core processor that includes two or more processors for enhanced performance, more efficient parallel processing, or other advantageous computing functions. In another implementation, the specially configured processor 202 may be one or more processing devices such as microprocessor(s) or integrated circuit(s) and may include one or more controllers. It should be appreciated that in some implementations, a general-purpose processor could be programmed to perform the functions of the specially configured processor 202.

A controller, in some implementations, is a device or a software program that manages or directs the flow of data between two entities. Often, controllers are special purpose circuitry or software that solve a technical communications problem between different technology systems. In some implementations, a controller functions as an interface between two systems while managing the communications between the systems. In another implementation, a controller functions as an interface between a processor and a peripheral device and functions to control the peripheral device.

At least one specially configured processor 202 or controller of control unit 200 may be specially configured to communicate with at least one memory device 204, generally shown as memory device 204 in FIG. 2. In some implementations, the memory device 204 includes one or more memory structures for storing instructions and various types of game data. The memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in some implementations, communication with the memory device 204 by the specially configured processor 202 or a controller, encompasses the processor or controller accessing the memory device 204, exchanging data with the memory device 204, or storing data to the memory device 204.

The memory device 204 may store all program code and game code (collectively the "code"), and operation data necessary for the operation of the control unit 200 providing a gaming device and execution of the gaming features described hereinbelow. In an alternative implementation, game code and operation data necessary for the operation of the control unit 200 may be stored in a distributed manner such that some code is stored in memory device 204 and other code is stored remotely from the control unit 200. In some implementations, the code and operation data necessary for the operation of the control unit 200 includes, for example, basic input and output function data, instruction fetching data, bus and network communication protocol data, and like data necessary for an operational gaming device. In some implementations, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in some implementations, the code and operation data for the operation of the gaming device described above may be stored in removable game cartridges or flash drives, a compact disk ROM, a digital versatile disk (DVD) optical storage technology, or suitable other fixed non-transitory storage mediums. In another implementation, part or all of the code and operational data for operation of the gaming device or for execution of the game features may be stored in a remote memory structure and be downloaded to the memory device 204 via a network connection.

In some implementations, the control unit 200 may utilize any combination of memory devices such as random access memory devices (RAMs), unalterable memory devices (ROMs), and mass storage devices for securely storing and securely communicating the software components or code that facilitate game play and other functions of the control unit 200. The memory devices may store software components or code that include various game data and game related control and execution software. In some implementations, the software components stored in the memory devices 204 may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the control unit 200.

In some implementations, memory devices, such as memory device 204, with the software components and other data may be secured and authenticated by authentication software stored in an unalterable memory device within the housing of the control unit 200. The control unit 200 may also include application specific integrated circuits (ASICs) to perform the security and authentication functions. At any appropriate time, such as before each play of a game, at a predetermined interval, upon transfer of any game data or any software components from a mass storage to the memory device 204, or upon demand, the control unit 200 (using a processor such as processor 202 or a separate ASIC) may execute an authentication routine and perform an authentication of any software component or other data of the control unit 200. In some implementations, the gaming device software components may be prepared for authentication via creation and storage of an encrypted signature unique to one or more of the software components.

In some implementations, an encrypted signature may be created by utilizing a hash function on a software component or code to form a message digest (i.e., a hash of the software component) followed by a key encryption of the message digest to form an encrypted signature unique to the software component. In some implementations, the key encryption may be public key encryption, private key encryption, or any suitable key encryption schema. The encrypted signature may be stored with the gaming device software component, for example, in a mass storage device or an unalterable memory. During a software component authentication, the gaming system 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and the control unit 200 may allow game play to proceed. However, when the message digests do not match, the control unit 200 may determine that the software component under authentication may be corrupted or fraudulent and game play may be halted. It should be appreciated that the control unit 200 may perform other suitable security and authentication checks on the game data or software components. Such authentication and security devices and functions are unique to gaming and casino industry to minimize or prevent fraud in gaming devices and gaming systems.

For a player to interact with a gaming device, the control unit 200 receives and processes player inputs, and the control unit 200 causes processed results to be output or communicated to the player. In some implementations, player inputs are recognized and processed or directed for processing by input/output (I/O) controller 206. Further, I/O controller 206 may process and direct player outputs for communication to the player. The I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for the attached input devices and output devices. In this manner, specially configured processor 202 is freed from the operational details of the peripheral I/O devices. For example, in some implementations where an input or output device is changed or upgraded, the I/O controller 206 can be changed without changing other gaming system components.

In some implementations, a player deposits value into a gaming device by inserting some form of currency into a value acceptor 208 for game play. Alternatively, a player deposits value into a gaming device by inserting an encoded paper ticket into a value acceptor 208 for game play in some implementations. The value acceptor 208 can be combined with a currency reader and validator, and a code reader for reading value encoded on paper tickets. The value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming system 100. During game play, the specially configured processor 202 processes a player's wagers and determines the amount of credits to debit from the player's credit balance. When a winning outcome is obtained, the specially configured processor 202 is configured to determine the amount of credits to add to the player's credit balance.

As previously mentioned with respect to FIG. 1, a variety of value acceptance arrangements are possible. In some implementations, the value acceptor 208 could include magnetic strip or chip card readers to accept and transfer value. The value acceptor 208 may also be configured to accept and transfer non-traditional currencies such as digital currencies. In these implementations, I/O controller 206, a specially configured processor 202, or both contain appropriate control instructions to communicate and extract value from the inserted item containing value. In some implementations, use of a magnetic strip or embedded chip card, for example a bank card, for value insertion requires the specially configured processor 202 to communicate, via network interface controller 224 (described below), with devices external to a gaming device.

In some implementations, a card reader 210 may be included in gaming system 100 to accept player loyalty cards. For example, card reader 210 can extract account identifying information from the card and utilizes this information to access the associated account information stored remotely via network interface controller 224. In implementations where player loyalty/player tracking systems are employed, a player's loyalty account and record of gaming activity can be stored in a networked storage location or database. The specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various implementations, a player control 212 receives a player's game inputs and communicates the player's game inputs to the specially configured processor 202. The player's game inputs may include, but are not limited to, wager amounts, pay line selections, game control signals, and cash-out signals. The player control 212 may generate signals based on button presses, touch screen activations, or voice control. The player-initiated signals are propagated to the specially configured processor 202 by the I/O controller 206. Further, the player-initiated signals may direct and inform execution of the game instructions stored in the memory device 204 and configured to be executed by the specially configured processor 202.

In some implementations, the specially configured processor 202 is configured to execute stored program code and instructions which generate random numbers or pseudo-random numbers. In some implementations, as illustrated in FIG. 2, a random number generator (RNG) 214 is a software module configured to be executed by the specially configured processor 202 for the generation of a true random or pseudo-random number. The code for RNG 214 may be stored in the memory device 204. The RNG 214 generates random numbers for use by the gaming software during game execution. In some implementations, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various implementations, once random symbols are selected based upon the random number generated by the RNG 214, patterns of symbols are compared to determine wagering outcomes. In an alternative implementation, gaming system 100 may include a hardware based random number generator that is in communication with specially configured processor 202 to supply random numbers for game generation purposes. The hardware based random number generator may be incorporated into specially configured processor 202 or can be separate from specially configured processor 202.

In yet another implementation, the random generation of "numbers" or symbols may be performed with electro-mechanical components. For example, gaming devices such as gaming system 100 may incorporate a mechanical reels rotatable about a common axis. Indicia or symbols may be positioned around the periphery of the reels. The indicia or symbols on the reels may indicate separate detectable reel stop positions. The reels can be set into a spinning/rotation motion by pulling a lever or pushing a button. In some implementations, the gaming system 100 can stop the reels by a gaming device actuating, on a random timing basis, a suitable mechanical or electro-mechanical reel brake. When the reels stop rotating, one or more displayed stop positions of the reels are detected. Since the stop positions are associated with respective indicia or symbols, the gaming device can determine whether the combination of stop positions (i.e., translating to a combination of displayed symbols) results in a winning symbol combination.

Returning to FIG. 2, the control unit 200 controls the function and output of a output devices utilized by a gaming device. In various implementations, I/O controller 206 serves as an interface unit between specially configured processor 202 and output devices such as video processor 216, cabinet lighting controller 218, audio controller 220, and value dispenser 222.

In some implementations, the video processor 216 communicates with specially configured processor 202 to render all game graphics, video displays, and information on one or more video display units (e.g., displays 120, 130, and 134). In some implementations, the video processor 216 includes one or more processors, controllers, and/or graphics cards for processing the game images, outcomes, and animated displays and coordinating the processed data to be display between, among, or across any or all display devices. In various implementations, this may include being configured to simulate objects and the movement of objects which represent video reels containing sets of gaming symbols.

It should be appreciated that in certain other implementations where physical mechanical reels are utilized by the gaming system 100 as a game displays, reel controllers and stepper motors would be provided in lieu of or in addition to video processor 216.

In implementations which utilize cabinet lighting as described with respect to FIG. 1, a cabinet lighting controller 218 may be utilized to coordinate and control the color and timing of cabinet lighting displays with specially configured processor 202. In certain implementations which utilize sound design, specially configured processor 202 may utilize audio controller 220 to coordinate and control the sound emissions. In some implementations, audio controller 220 may include one or more audio processing cards for generating sound and for driving the one, two or more speakers that may be included with a gaming device.

In various implementations, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In some implementations, value dispenser 222 can be controlled to issue the player's credit value using any of the types of value discussed herein. In some implementations, the player's credit value may be issued to the player via a printed and dispensed encoded paper ticket or token which the player can then exchange at a special purpose kiosk or cashier location for the monetary value encoded into the ticket or token. In some implementations, the specially configured processor 202 can direct the value dispenser 222 to issue to the player an appropriate amount of coin or bills directly to the player. Additionally, or alternatively, in some implementations, the player may have the option to electronically direct the credit value to an account associated with the player.

In some implementations, the control unit 200 may communicate with one or more devices outside the gaming device. For example, gaming system 100 may be connected to a larger network 240 via a local area network (LAN) or a wide area network (WAN). The control unit 200 may communicate with one or more central servers, controllers, or remote devices to execute games, establish credit balances, participate in jackpots, etc. In such implementations, network communications and connections are accomplished via a network interface controller 224. Network interface controller 224 can be a digital circuit board or card installed in control unit 200 to provide network communications with external devices.

In some implementations, various additional features and functions are performed by the control unit 200. For example, the control unit 200 may be specially configured with appropriate software to track all game play events that occur on a gaming device. In some implementations, the control unit 200 may audit all recorded monetary transactions, including all wager amounts, game outcomes, game winnings, and game payouts that occur through the value dispenser 222. Further, some implementations may include security software to assist in protecting the gaming system 100 from tamper or alteration attempts.

Gaming System Operation

Figure 3A:
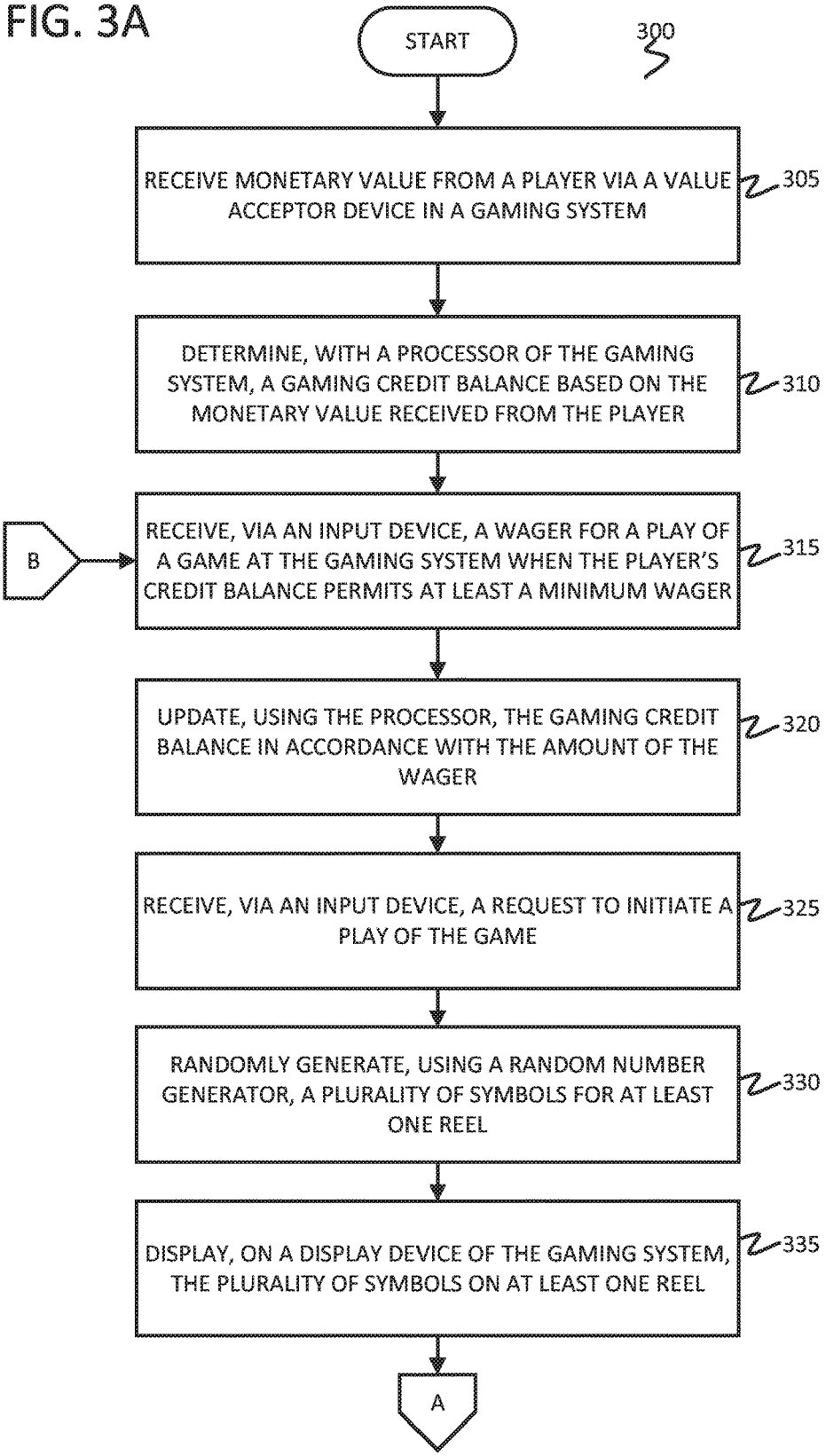
FIG. 3A shows a process flow diagram illustrating an example method of operating the gaming system that converts symbols in accordance with aspects of the present disclosure.
Figure 3B:
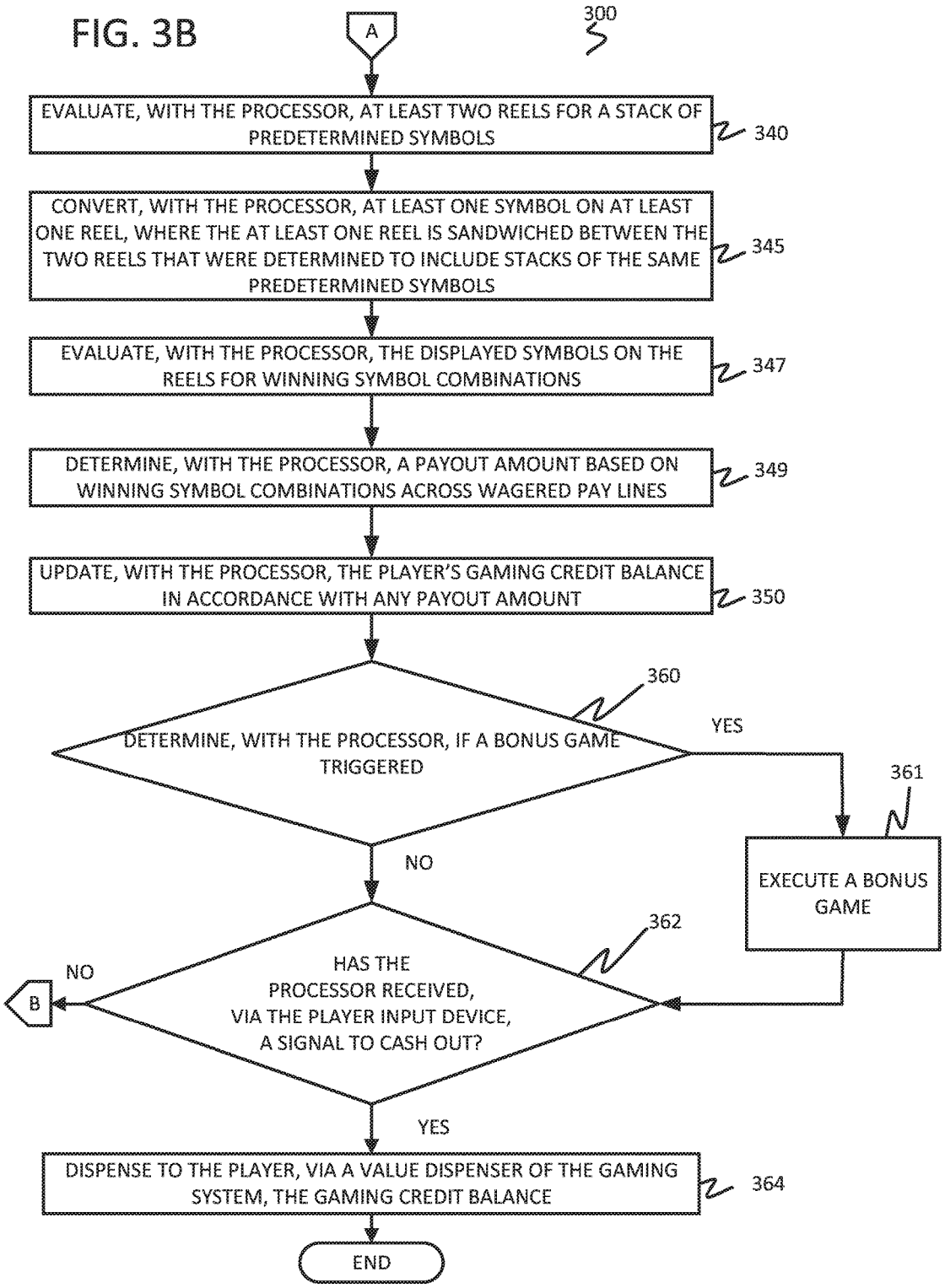
FIG. 3B shows a process flow diagram illustrating an example method of operating the gaming system that converts symbols based on stacked symbols in accordance with aspects of the present disclosure.

The flowcharts in FIGS. 3A and 3B illustrate functionality and operation of possible implementations of systems, devices, methods, and computer program products according to various implementations of the present disclosure. Each block in the flow diagrams of FIGS. 3A and 3B can represent a module, segment, or portion of program instructions, which includes one or more computer executable instructions for implementing the illustrated functions and operations. In some alternative implementations, the functions and/or operations illustrated in a particular block of the flow diagram can occur out of the order shown in FIGS. 3A and 3B. For example, two blocks shown in succession can be executed substantially concurrently, or the blocks can sometimes be executed in the reverse order, depending upon the functionality involved. It will also be noted that each block of the flow diagram and combinations of blocks in the block diagram can be implemented by special purpose hardware-based systems that perform the specified functions or acts, or combinations of special purpose hardware and computer instructions. In some implementations, flowchart can include more blocks or fewer blocks.

FIGS. 3A and 3B show a process flowchart illustrating an example of method 300 of operating the gaming system (e.g., gaming system 100) providing symbol conversions based on stacked symbols in accordance with aspects of the present disclosure. FIGS. 3A and 3B describe parts of a base or primary game. However, it is understood that FIGS. 3A and 3B may be integrated as part of a bonus game.

In some implementations, one or more processors (e.g., processor 202) of the gaming system are configured, via instructions (e.g., gaming module) stored in a memory device (e.g., memory 204 or a storage system), to perform the method 300. In block 305, the gaming system receives monetary value via a value acceptor device (e.g., value acceptor 208). In block 310, the gaming system determines a credit balance based on the monetary value received from the player in block 305 at a value acceptor device. In block 315, the gaming system receives a wager for a play of a game from a player via an input device (e.g., player controller 212) using, e.g., the credit balance determined at block 310.

In some implementations, the gaming system allows the player to place a minimum wager, a maximum wager, or any suitable wager amount. In some implementations, the player's wager amount may determine the value of some of the available awards. Depending on the wager amount, the gaming system may also enable the player to select pay lines across displayed symbol positions (e.g., symbol display areas) on reels in a game in which to place wagers. Although in some implementations, the gaming system selects the wagered pay lines automatically based on the player's wager. Wagered pay lines may be referred to herein as active pay lines. In some implementations, the gaming system determines whether the credit balance determined at block 315 includes enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system. At block 320, the gaming system updates the credit balance determined at 310 in accordance with the amount wagered at 315.

At block 325, the gaming device receives a request to initiate a play of the game via the input device. For example, the player may press a spin button on the gaming system to start spinning slot machine reels of the gaming system (or randomly generating symbols using other methods discussed above for virtual reels) for the play of the game. In some implementations, a play of a game begins with a wager and activation of a game and the play of the game ends when the features of the base, bonus, or both have completed (depending on whether a bonus game is played). In another implementation, one play of a game comprises the processor executing blocks 315-361, and terminating at either block 360 or 361 depending on whether the gaming system activates a bonus game. In some implementations, block 362 and block 364 are not part of a play of a game. In alternative implementations, block 362 and block 364 are part of a play of a game.

It should be appreciated that reels or slot machine reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

At block 330, the gaming system randomly generates, using a random number generator (e.g., random number generator 214) game symbols for at least one reel of the gaming system from a first symbol set.

Figure 4A:
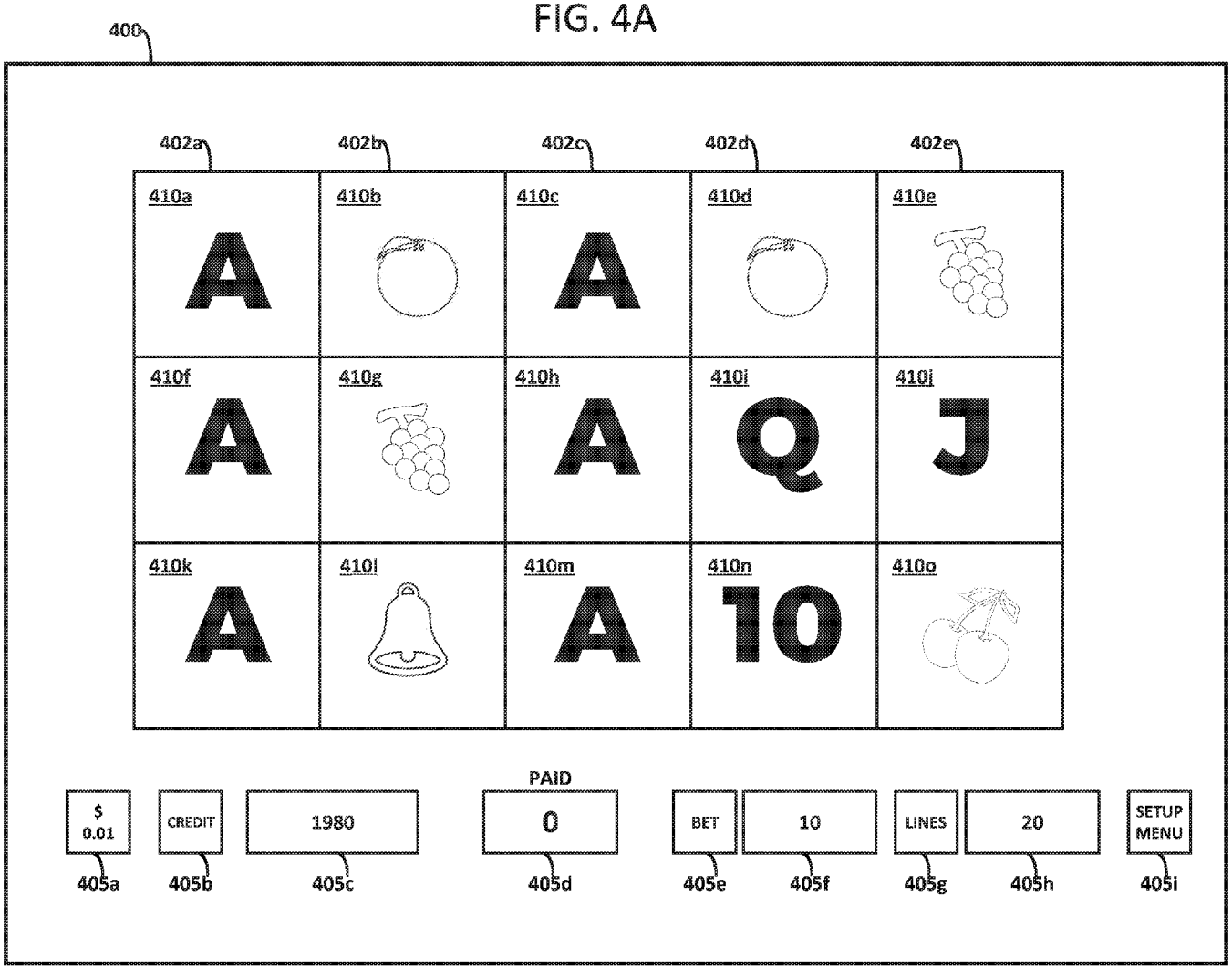
FIG. 4A shows a picture of a gaming system display illustrating an example symbol conversion based on stacked symbols in accordance with aspects of the present disclosure.

In some implementations, the gaming system may generate symbols for display on at least one reel (e.g., reel 402*a* in FIG. 4A). In some implementations, the gaming system may generate the symbols for display on a set of reels (e.g., reels 402*a*-402*e* in FIG. 4A). In some such implementations, the reels are associated with respective sets of symbols. At block 335, the gaming system causes a display device (e.g., first display device 120) to display the symbols generated at 330. For example, in a game using reels, the gaming system may display the generated symbols in visible symbol display areas of the individual reels.

Turning now to FIG. 3B, as indicated by off-page connector A, at block 340, the gaming system evaluates at least two reels for a stack of predetermined symbols (e.g., a symbol stack). In some implementations, a reel includes a symbol stack when the gaming system generates a predetermined quantity of the same or similar symbols in adjacent symbol display areas of the same reel (e.g., creating a column of substantially identical symbols). For example, the predetermined quantity of symbols may be two, such that a symbol stack on a reel may include two King symbols in adjacent symbol display areas of the same reel. A symbol stack on a reel may include more than two of the same or similar symbols in adjacent symbol display areas of the same reel (e.g., three or more King symbols). In some implementations, the predetermined quantity of symbols for a symbol stack is three or more symbols of the same or similar symbols. In some implementations, the predetermined quantity of symbols is equal to the available symbol display areas for a reel.

It should be appreciated that in some implementations, the gaming system does not evaluate multiple of the same or similar symbols on a reel to be a symbol stack when the predetermined quantity of same or similar symbols on the same reel are separated by different symbols. For example, a King symbol on a reel followed by a Cherry symbol followed by another King symbol on the same reel does not form a symbol stack of King symbols in some implementations. However, where the gaming system generates a King symbol on a reel followed by another King symbol on the reel, followed by a Cherry symbol on the reel, the gaming system forms a symbol stack of King symbols when the predetermined quantity of symbols for a symbol stack is two symbols. In some implementations, the gaming system must generate the same or similar symbol in all symbol display areas of a reel to form a symbol stack.

In some implementations, the gaming system is configured to generate certain predetermined symbols from the symbol set as stacked symbols. For example, in some implementations, the gaming system can generate royal symbols (e.g., Jack symbols, Queen symbols, King symbols, etc.) as stacked symbols, while other symbols in the symbol set cannot be generated in as stacked symbols. In some implementations the predetermined symbols that can be stacked symbols are associated with low value awards, but not high value awards. In some implementations the predetermined symbols that can be stacked symbols are associated with high value awards, but not low value awards. It should be appreciated that any suitable symbol in the symbol set can be generated in a symbol stack in some implementations.

In some implementations, the gaming system is configured to generate symbol stacks on certain predetermined reels. For example, the gaming system may be configured to generate symbol stacks on reels one and three of a five reel set, but not on other reels. In some implementations, the gaming system may generate symbols stacks on reels one, three, and five of a five reel set. In some implementations, the gaming system is configured to generate symbol stacks on any of the reels. It should be appreciated that determining which symbols can be generated in symbol stacks and which reels can have symbol stacks can change the game's return to player percentages (and the house percentages).

Returning to block 340, the gaming system evaluates at least two reels for symbol stacks. In some implementations, the gaming system evaluates more than two reels for symbol stacks. In some implementations, the gaming system evaluates all of the reels for symbol stacks. In some implementations, where the gaming system determines that at least two reels include symbol stacks, the gaming system also determines whether the symbol stacks in the two different reels include the same symbols that form the symbol stacks.

In some implementations, if the gaming system determines that at least two of the reels include symbol stacks, the gaming system determines whether any reels are sandwiched between the reels with symbol stacks. For example, if the gaming system displays a five reel game and reel 1 and reel 3 includes symbol stacks, the gaming system determines if any reel is sandwiched between reel 1 and reel 3. In such an example, the gaming system determines that reel 2 is the sandwiched reel between reel 1 and reel 3. In some implementations, a sandwiched reel must be directly adjacent to two reels with stacked symbols (e.g., reel 2 is a sandwiched reel because it is adjacent to reels 1 and 3). Adjacent reels 1 and 3 with stacked symbols are also referred to herein as surrounding reels. In some implementations, a sandwiched reel does not need to be directly adjacent to two reels with stacked symbols. For example, in some implementations, if reel 1 and reel 4 include stacked symbols, reel 2 may be considered a sandwiched reel between reel 1 and reel 4. In such an example, reel 3 may also be considered a sandwiched reel between reel 1 and reel 4. In some implementations, the gaming system may select one or both of reels 2 and 3 to be considered sandwiched reels.

At block 345, the gaming system converts at least one symbol on a reel that is sandwiched between two reels (e.g., a sandwiched reel) that were determined to include stacked symbols. In some implementations, the gaming system converts at least one symbol on each sandwiched reel. In some implementations, the gaming system performs the conversion when the symbols that form both stacked symbols on the different reels are the same or similar symbols (e.g., both symbol stacks include King symbols), but not when the symbols that form stacked symbols on one of the reels is different from the stacked symbols on the other reel (e.g., one symbol stack include King symbols while the other symbol stack include Jack symbols).

In some implementations, the conversion of at least one symbol on a sandwiched reel includes converting the at least one symbol into a symbol that matches the symbols in the symbol stacks of the surrounding reels. In some implementations, the conversion of at least one symbol on the reel includes converting the at least one symbol into a symbol that is different from the symbols in the symbol stacks of the surrounding reels (e.g., a wild symbol, a multiplier symbol, a bonus game triggering symbol). It should be appreciated that the converted symbol can be any suitable symbol. In some implementations, the conversion of at least one symbol on the reel includes converting the at least one symbol into a symbol that will provide an award to the player that would not have been available, but for the conversion based on the surrounding symbol stacks. In some implementations, the conversion of at least one symbol on the reel does not include converting the at least one symbol into a symbol that would cause the player to lose an award.

In some implementations, the gaming system converts multiple symbols on a sandwiched reel. In some implementations, the gaming system converts the same quantity of symbols in a sandwiched reel as the quantity of symbols in one of the surrounding stacks of symbols. In some implementations, the gaming system converts symbols in a sandwiched reel that align horizontally with a symbol in the stacked symbols of the two reels.

In some implementations, the gaming system performs a first type of conversion when the symbols that form both stacked symbols on the different reels are the same or similar symbols, but performs a different second type of conversion when the symbols that form stacked symbols on one of the reels is different from the stacked symbols on the other reel. For example, the first type of conversion may include converting more symbols in a sandwiched reel than would be converted during the second type of conversion. In another example, the first type of conversion may include converting symbols in a sandwiched reel into symbols that match symbols in the symbol stacks, while the second type of conversion includes converting symbols in a sandwiched reel into symbols different from one or both symbols that form the symbol stacks.

At block 347, the gaming system evaluates the displayed symbols on the reels for winning symbol combinations after the conversion performed at block 345. Where the gaming system has converted symbols on sandwiched reels, the gaming system may evaluate the converted symbols with any remaining symbols that were generated in connection with block 330 for winning symbol combinations. To the extent that no symbols were converted in block 345, the displayed symbols are the symbols generated in block 330.

In some implementations, gaming system evaluates the displayed symbol across active or wagered pay lines for winning symbol combinations. In some implementations, the gaming system evaluates the winning symbol combinations based on the pay lines wagered upon by a player. The gaming system may evaluate the player selected pay lines, gaming system assigned pay lines, or pay lines assigned as active in some other manner for the play of the game. In some implementations using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In some implementations, a pay table may indicate that as few as one symbol may be associated with a payout. Alternatively, two or more symbols may be used to form winning symbol combinations that result in a payout.

In some implementations, the gaming system may evaluate the displayed symbols on the reels for winning symbol combinations prior to executing block 340 and block 345 (not shown). In such an implementation, the gaming system enables the player to obtain awards associated with the originally generated symbols alone (e.g., generated in block 330) and additional awards based on the converted symbol with the remaining originally generated symbols.

At block 349, the gaming system determines a payout amount based on the winning symbol combinations across wagered pay lines evaluated at block 347. At block 350, the gaming system updates the player's gaming credit balance in accordance with the payout amount determined at 349. As noted above, the blocks illustrated in FIGS. 3A-3B can be rearranged in any suitable order. As such, it should be appreciated that the gaming system may update player's gaming credit balance at other suitable times.

It should be appreciated that the symbol conversion can cause a gaming system to display large symbols stacks of the same symbols. In some implementations, all of the reels may display the same symbols in symbol stacks. Thus, converting symbols based on stacked symbols can create large quantity of winning pay lines for the player. Doing so improves the operation of the gaming machines for their specialized purpose by reducing player disappointment with game outcomes and enhancing player excitement for a play of a game.

In some implementations, as indicated in block 360, the gaming system determines whether a bonus game is triggered. In some implementations, the gaming system evaluates the displayed symbols for at least one symbol combination of predetermined symbols that triggers a bonus game. It should also be appreciated that in some implementations, events other than generating one or more of a predetermined symbol may trigger the bonus game. For example, the gaming system may include or be in communication with a mystery bonus controller. The mystery bonus controller may randomly determine or determine based on a predetermine triggering event (quantity of games played) to trigger or active a bonus game.

Where the gaming system determines that a bonus game is triggered, the gaming system may execute a bonus game as shown in block 361. On the other hand, where the gaming system determines that a bonus game is not triggered, in block 360, operation 300 moves to block 362. In some implementations, as indicated in block 362, the gaming system may receive a signal to end game play or "cash out" via an input device of the gaming system (which would end the gaming session). In such a situation, the gaming system dispenses a value to the player, through a value dispenser, based on the player's gaming credit balance as illustrated in block 364 and operation 300 ends.

On the other hand, if the gaming system processor has not received a signal to end game play (e.g., the player continues a gaming session to play another play of the game) via the player input device, the process of operation 300 returns to block 315, as indicated by off-page connector B. The gaming system may receive, via a player input device, a wager for another play of the game and continue operation 300 from block 315. However, in some implementations, the wager may not be accepted if the player has fewer credits than the player's selected wager amount, as shown in block 315.

FIGS. 4A-4D show pictures of a gaming system display illustrating an example symbol conversion based on stacked symbols in accordance with aspects of the present disclosure. More specifically, FIGS. 4A-4D illustrate screen shots of one implementation of a gaming system converting symbols based on symbol stacks to obtain enhanced awards. FIG. 4A illustrates one implementation of a game display 400 that the gaming system 100 may display on a display device of the gaming system. In some implementations, game display 400 may be displayed on first display 122 of gaming system 100 illustrated in FIG. 1. However, any other suitable display may be used. The game display 400 displays a set of a virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements (e.g., reels, symbol display areas, symbols, etc.) shown in the game display 400. It should also be appreciated that other games may be used for the primary or base game.

In some implementations, the reels 402*a*-402*e* are each respectively associated with a set of symbols or a symbol set, where each set of symbols includes a number of symbols. The sets of symbols can be associated with the same or different symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols.

In some implementations, at least one predetermined symbol is a triggering symbol for a bonus game. However, in some implementations, a bonus game is triggered in alternative ways. In one such alternative implementation, a bonus game can be triggered by a mystery bonus controller in communication with the gaming system. In some implementations, at least one triggering symbol must be generated on the reels during a play of a game to trigger the bonus game. In some implementations, triggering symbols must be generated on the reels during a play of a game to trigger the bonus game. In some implementations, any one of the symbols in the symbol sets can be designated as the predetermined triggering symbol. The triggering symbol may be associated with one function (e.g., triggering a bonus game), but may alternatively be associated with a plurality of different game functions. The triggering symbol may be a scatter symbol in some implementations.

Returning to FIG. 4A, the game display 400 depicts a plurality of symbol display areas (also referred to herein as symbol display positions) 410*a*, 410*b*, 410*c*, 410*d*, 410*e*, 410*f*, 410*g*, 410*h*, 410*i*, 410*j*, 410*k*, 4101, 410*m*, 410*n*, and 410*o*. These plurality of symbol display areas can be associated in a manner that provides the appearance of game reels. It should also be appreciated that the symbol display areas may not be associated with game reels in some implementations. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In some implementations, the plurality of symbol display areas that provide the appearance of five game reels may be arranged in a manner that visibly shows three symbol positions of each of the five game reels. For example, the symbol display areas 410*a*-410*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the implementation of FIG. 4A thus creates a visible display area of the reels 402*a*-402*e* comprising three visible symbol positions for each reel. When viewed together, reels 402*a*-402*e* appear like a 3-row by 5-column reel array in display 400. In other implementations, smaller or larger visible areas of the reels can be displayed. That is, the reels 402*a*-402*e* may show fewer or a larger number of visible symbol display areas. In some implementations, some symbol display areas can be hidden to hold generated symbols for use when the reels are nudged, as is discussed herein. While symbol display areas are illustrated with defined boxes, it should be appreciated that in some implementations, the defined boxes are not visible to the player. It should also be appreciated that in some implementations, the symbol display areas are other shapes or not defined shapes and may not be associated with reels.

Each reel 402*a*-402*e* may display a plurality of symbols that the gaming system generates from the sets of symbols in their respective symbol display areas as illustrated in FIG. 4A. In some implementations, the individual reels may be shown spinning in one direction to simulate slot machine reels. However, it should be appreciated that the reels may be shown spinning in any suitable direction. The reels may also be shown spinning in different directions in some implementations. In some implementations, the gaming system does not depict reels or spinning symbols.

Game display 400 also includes several information areas and buttons 405*a*-405*i*. These information areas and buttons 405*a*-405*i* are illustrated in a particular arrangement, but may be arranged in any suitable manner in different implementations. In some implementations, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming system 100. Information area 405*f* illustrates that the player has selected to wager 200 credits. Button 405*g* illustrates a software button that the player can select to determine how many pay lines to wager on. It should be appreciated that the functionality of button 405*g* may also be replicated or replaced with a hardware button on the gaming system 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on the play of the game. The gaming system may provide a visual indication of the player's credit balance to the player as discussed above in information area 405*c*.

To initiate the play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels for each of the reels 402*a*-402*e*. The spinning may appear to occur in a vertical top to bottom direction or in a vertical bottom to top direction (not shown), or in a combination of vertical directions (not shown). In some implementations, the gaming system randomly generates symbols from the associated sets of symbols for reels 402*a*-402*e*, respectively. As noted above, the gaming system may rely on random generation performed by a pseudo RNG, a true RNG, or hardware RNG specifically designed for gaming systems. In some implementations, the gaming system may also update the player's credit meter (information area 405*c*) to reflect the player's available credit balance. As shown in FIG. 4A, the player's credit meter (information area 405*c*) was decremented by 400 credits from 2380 to 1980 to reflect the 400 credit wager the player placed for the play of the game.

The gaming system displays the generated symbols in symbol display areas 410*a*-410*o* as illustrated in FIG. 4A. Symbols displayed on reels 402*a*-402*e* illustrate the randomly generated symbols from the symbol sets after the reels have stopped spinning. As illustrated in FIG. 4A, the gaming system randomly generated and displayed symbols in symbol display areas 410*a*-410*o* for reels 402*a*-402*e*.

As illustrated in FIG. 4A, the gaming system generated and displayed Ace symbols in symbol display areas 410*a*, 410*c*, 410*f*, 410*h*, 410*k*, and 410*l*; Orange symbols in symbol display areas 410*b* and 410*d*; Grape symbols in symbol display areas 410*e* and 410*g*; a Queen symbol in symbol display area 410*i*; a Bell symbol in symbol display area 410*l*; and a Cherry symbol in symbol display area 410*o* in the game display 400. It should be appreciated that the displayed symbol combinations are merely for explanatory purposes and the gaming system may randomly generate any suitable combination of symbols based on defined symbol sets associated with the reels 402*a*-402*e*. In this implementation, the Ace symbols were designated as predetermined symbols that can appear as stacked symbols on at least reel 402*a* and reel 402*c*. In alternative implementations, other symbols could be designated as predetermined symbols that can generated as stacked symbols. In the implementation illustrated in FIG. 4A, the gaming system evaluated the generated symbol combinations for winning symbol combinations. In FIG. 4A, the gaming system determined that no winning symbol combinations are displayed across wagered pay lines.

In some implementations, the gaming system may execute an evaluation of the generated symbols on reels 402*a*-402*e* for winning symbol combinations. As noted above, the player may have wagered on one or more pay lines (such as 10 pay lines shown in information area 405*h*). In some implementations, at least the active (wagered on pay lines) are evaluated for winning symbol combinations. Any suitable number of pay lines may be used to evaluate winning symbol combinations. In alternative implementations, the gaming system does not evaluate the generated symbols until after the reels have been evaluated for stacked symbols and any possible symbol conversions has been applied based on the stacked symbols.

In some implementations, the gaming system evaluates the generated reels for stacked symbols (referred to herein in the alternative as "symbol stacks"). As shown in FIG. 4A, reels 402*a* and 402*c* include multiple Ace symbols in adjacent symbol display areas. Reel 402*a* includes Ace symbols in symbol display areas 410*a*, 410*f*, and 410*k*. Likewise, reel 402*c* includes Ace symbols in symbol display areas 410*c*, 410*h*, and 410*m*. As noted above, when the gaming system generates the same or similar symbols in adjacent symbol display areas of a reel, the gaming system will determine that a symbol stack was generated. In some implementations, the gaming system requires that the symbol stacks in different reels include the same quantity of matching symbols before executing a symbol conversion. In other implementations (as will be illustrated in FIGS. 6A and 6B), the symbol stacks in different reels to do not require the same quantity of symbols in the symbol stacks to cause the gaming system to execute a symbol conversion.

In some implementations where less than all of the reels can generate stacked symbols, the gaming system limits its evaluation of the reels for stacked symbols. By skipping evaluation of all of the reels, the efficiency of the gaming system can be improved because less memory and less processing power is used during the gaming system's evaluation for each round/play of the game. This efficiency also translates into faster game play because less time is used to complete the game's evaluation. When such efficiency improvements are made and applied to the hundreds and thousands of game evaluations that are made on a casino floor for the disclosed gaming system, the new gaming system will provide casino game operators sizable gains in machine efficiency, which is a technological improvement.

In some implementations, where the gaming system determines that at least two reels include symbol stacks and the symbol stacks include matching symbols, the gaming system also determines whether at least one sandwiched reel exists between the surrounding reels with symbol stacks. As shown in FIG. 4A, the gaming system determines that reel 402*b* is a sandwiched reel between reels 402*a* and 402*c*. In some implementations, more than one reel can be a sandwiched reel. For example, if the gaming system generated the stacked symbols on reel 402*d* rather than 402*c*, then reels 402*b* and 402*c* could be sandwiched reels. However, in alternative implementations, a sandwiched reel can be limited to one reel surrounded by directly adjacent reels with stacked symbols, as is shown in FIG. 4A.

Figure 4B:
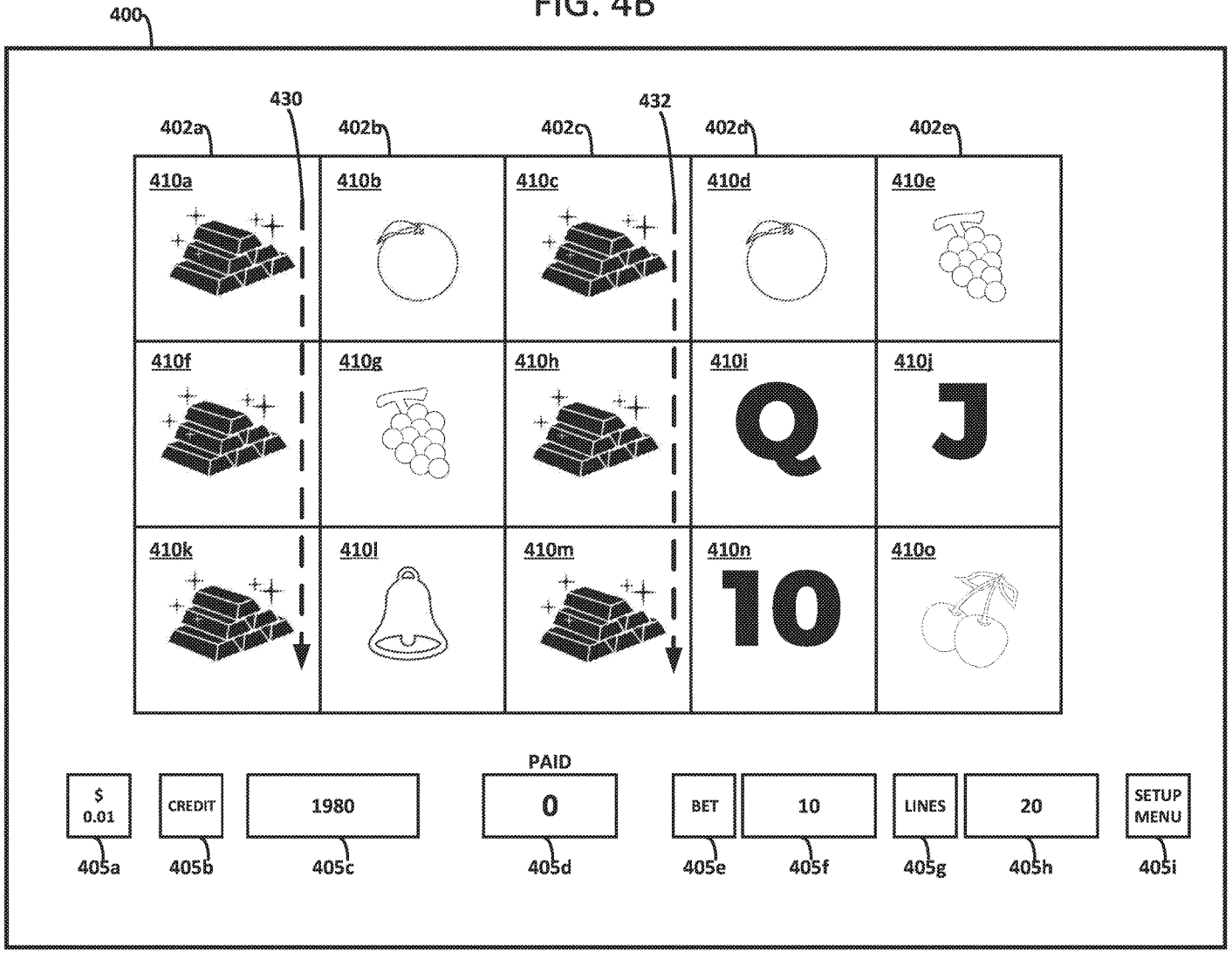
FIG. 4B shows a picture of a gaming system display illustrating an example symbol conversion based on stacked symbols in accordance with aspects of the present disclosure.

In some implementations, when the gaming system determines that at least two reels include symbol stacks, the symbol stacks include matching symbols, and at least one sandwiched reel exists, the gaming system may generate additional symbol stacks covering the symbols forming the original symbols stacks. As illustrated in FIG. 4B, the gaming system generated a stack of Gold Bar symbols in reels 410*a*, 410*f*, and 410*k* on reel 402*a* (e.g., generated additional symbol stacks). The gaming system also generated a stack of Gold Bar symbols in reels 410*c*, 410*h*, and 410*m* on reel 402*c*. In some implementations, the gaming system shows the Gold Bar symbols sweeping in from the top of the reel to the bottom of the reel as shown with direction arrows 430 and 432. However, it should be appreciated that the Gold Bar symbols can be shown sweeping in from any suitable direction or can be generated and displayed over the symbol stacks in some other suitable manner. In some implementations, any suitable symbol can be used in substitution for the Gold Bars symbols.

In some implementations, the gaming system does not replace the symbols in the symbol stacks with the new stacked symbols. For example, the additional generated symbol stacks may simply be overlaid over the originally generated and displayed stacked symbols.

In some implementations, the gaming system randomly determines which symbols to use instead of the Gold Bar symbols. In some implementations where the gaming system uses different symbols to cover the originally generated and displayed stacked symbols, the different symbols may cause different outcomes in the symbol conversions that are discussed below. For example, in some implementations Gold Bar symbols may cause the maximum quantity of symbols in a sandwiched reel to be converted into symbols that match with the originally generated stacked symbols. In some implementations, if the gaming system generated a different symbol from the Gold Bar symbols (e.g., a Silver Bar symbol), the gaming system may convert fewer symbols on the sandwiched reel that match with the originally generated stacked symbols. Other different alternative conversion outcomes can be associated with different symbols.

Figure 4C:
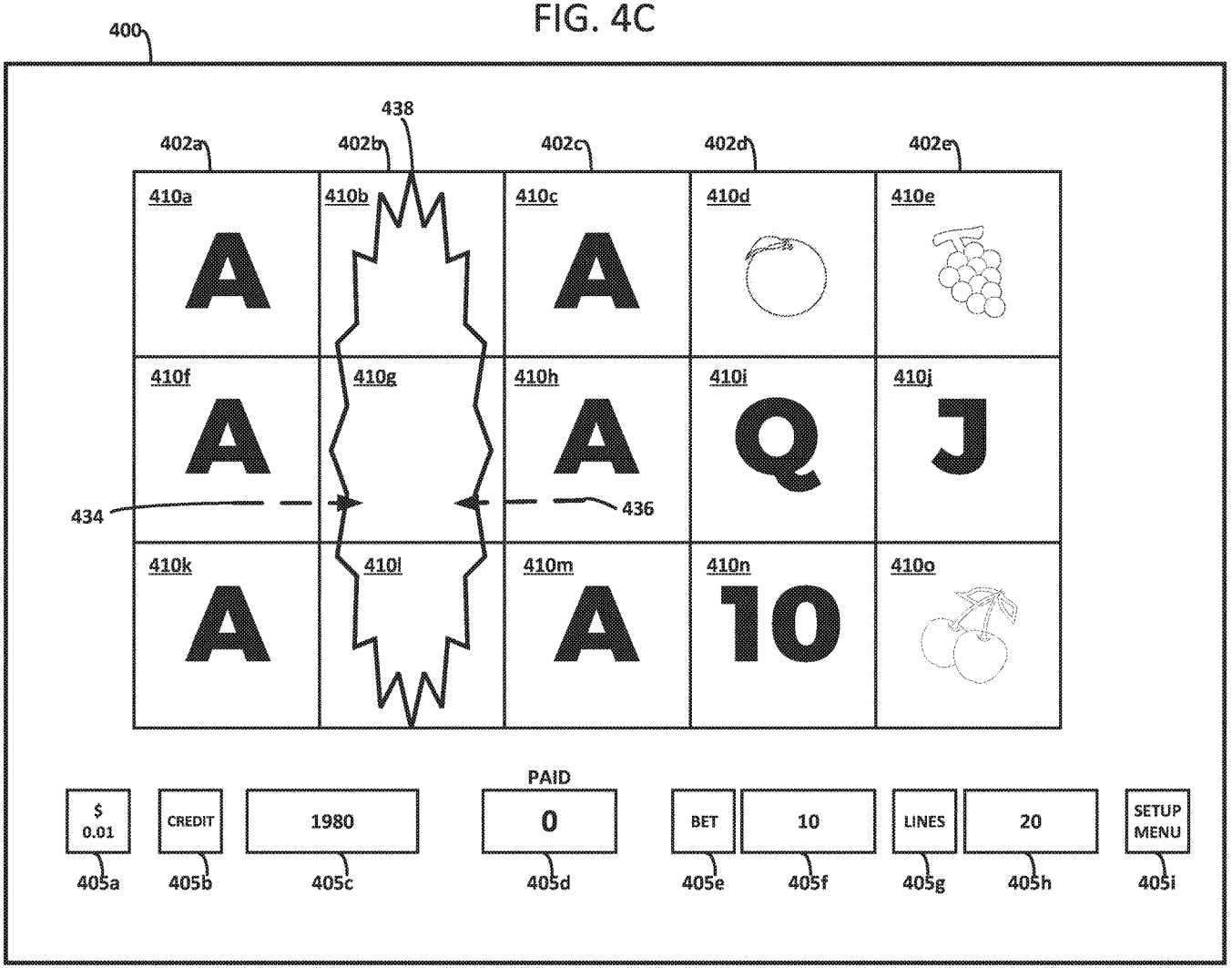
FIG. 4C shows a picture of a gaming system display illustrating an example symbol conversion based on stacked symbols in accordance with aspects of the present disclosure.

Turning to FIG. 4C, in some implementations, after the gaming system generates the overlaid Gold Bar symbols over the stacked Ace symbols, the gaming system may cause the Gold Bar symbols to crash together. For example, as shown in FIG. 4C, direction arrows 434 and 436 illustrate that the Gold Bar symbols on surrounding reels 402*a* and 402*c* crashed together over the sandwiched reel 402*b*. In some implementations, the Gold Bar symbols crash together to create an explosion, such as explosion 438. The explosion 438 causes the gaming system to convert the symbols on the sandwiched reel 402*b* into different symbols. It should be appreciated that in some implementations, the gaming system does not generate additional stacked symbols overlaid on the originally generated stacked symbols and does not cause such additional stacked symbols to crash together, triggering a conversion of symbols on a sandwiched reel. For example, in some implementations, the gaming system may cause symbols on a sandwiched reel to convert into different symbols without generating Gold Bar symbols. The symbols stacks on reels surrounding a sandwiched reel is enough in some implementations to trigger the gaming system to execute the symbol conversion discussed herein.

Figure 4D:
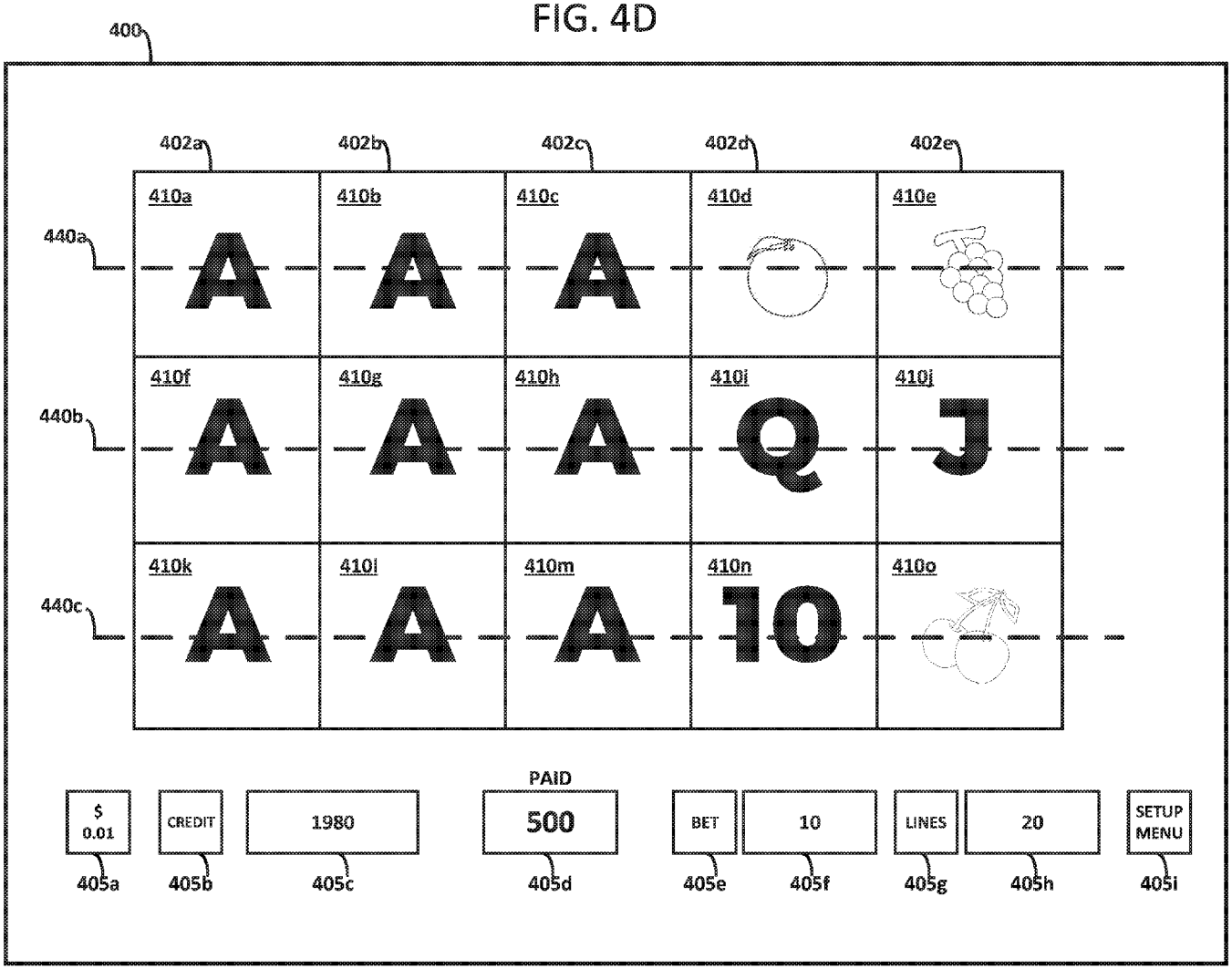
FIG. 4D shows a picture of a gaming system display illustrating an example symbol conversion based on stacked symbols in accordance with aspects of the present disclosure.

As shown in FIG. 4D, the gaming system converted the symbols on the sandwiched reel 402*b* in Ace symbols (e.g., symbols that are the same or similar to the symbols in the symbol stacks on reels 402*a* and 402*c*). In the illustration of FIG. 4D, the gaming system did not convert the symbols on reels 402*d* or 402*e* because these reels were not sandwiched between another reel with stacked symbols.

As also shown in FIG. 4D, the gaming system also evaluated the displayed symbols for winning symbol combinations. In FIG. 4D, the gaming system determined that reels with winning symbol combinations were formed based on multiple combinations of three Ace symbols appearing on certain wagered pay lines. For example, pay line 440*a*, 440*b*, and 440*c* were active pay lines and three consecutive Ace symbols were generated along these pay lines.

As also illustrated in FIG. 4D, the gaming system determines a payout amount for the play of the game based on the displayed winning symbol combinations of Ace symbols and an associated pay table (not shown). The gaming system updates the player's gaming credit balance (405*d*) in accordance with the calculated award amount for the bonus game. In some implementations, the play of the game ends.

The player may continue the gaming session (e.g., another consecutive play of the game) by executing another play of the game. That is, the player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Figure 5A:
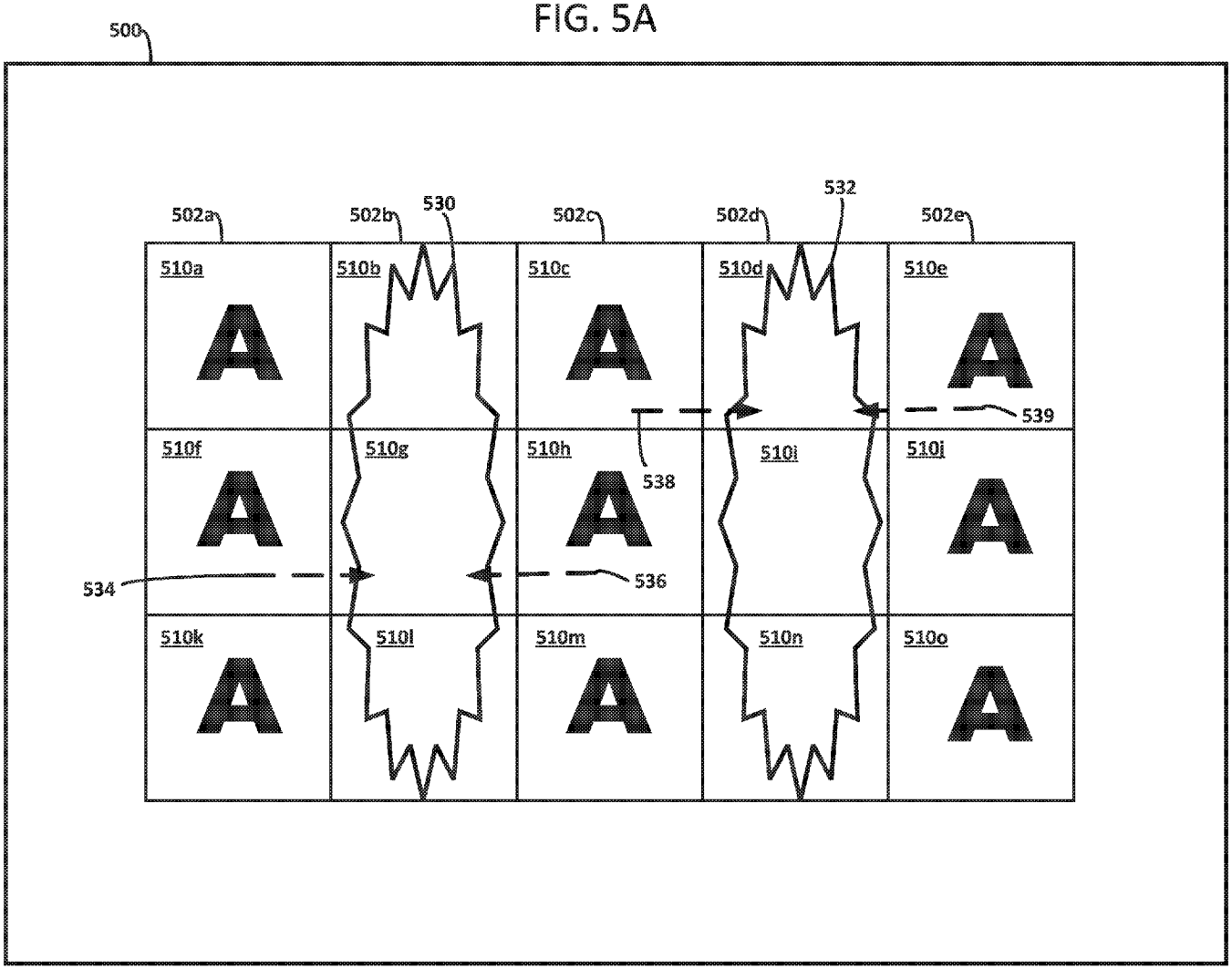
FIG. 5A shows a picture of a gaming system display illustrating an example symbol conversion based on stacked symbols in accordance with aspects of the present disclosure.
Figure 5B:
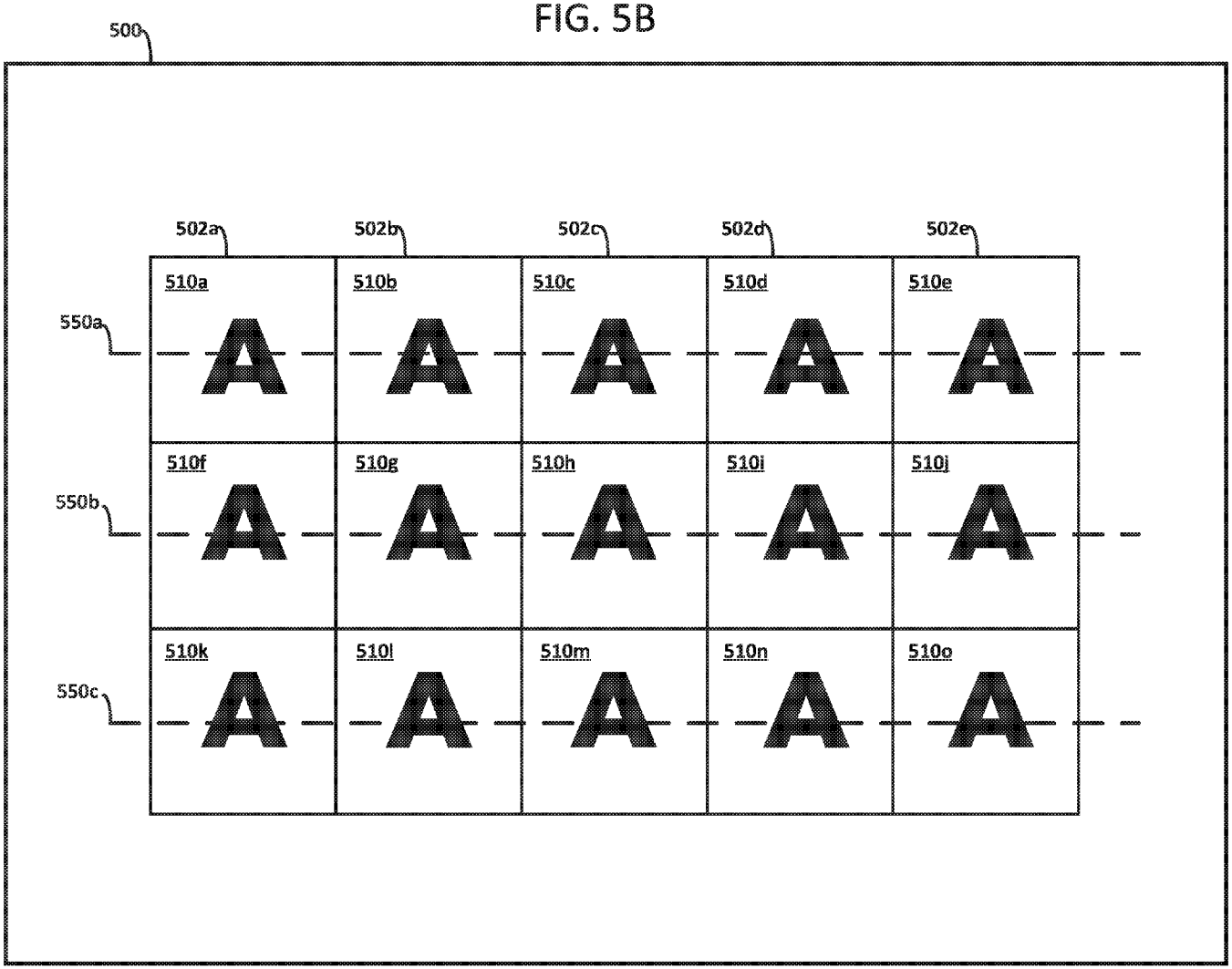
FIG. 5B shows a picture of a gaming system display illustrating an example symbol conversion based on stacked symbols in accordance with aspects of the present disclosure.

FIGS. 5A and 5B show pictures of a gaming system display illustrating another example symbol conversion based on stacked symbols in accordance with aspects of the present disclosure. For the sake of brevity, FIGS. 5A and 5B share features similar to the features already discussed above in connection with FIGS. 3A, 3B, and 4A-4D and such similar feature will not be described again. FIGS. 5A and 5B illustrate screen shots of one implementation of a gaming system converting symbols based on symbol stacks to obtain enhanced awards, where stacked symbols are generated on more than two reels. FIG. 5A illustrates one implementation of a game display 500 that the gaming system 100 may display on a display device of the gaming system. In some implementations, game display 500 may be displayed on first display 122 of gaming system 100 illustrated in FIG. 1. However, any other suitable display may be used. The game display 500 displays a set of a virtual video slot machine reels 502*a*, 502*b*, 502*c*, 502*d*, and 502*e* as illustrated in FIG. 5A for a primary or base game. As also illustrated in FIG. 5A, the reels 502*a*-502*e* are displayed substantially side by side. It should be appreciated that reels 502*a*-502*e* can be displayed with any suitable amount of separation or no separation. It should be appreciated that the game shown in game display 500 is merely representative and may have more or fewer game elements (e.g., reels, symbol display areas, symbols, etc.) shown in the game display 500. It should also be appreciated that other games may be used for the primary or base game.

In some implementations, the reels 502*a*-502*e* are each respectively associated with a set of symbols or a symbol set, where each set of symbols includes a number of symbols. The sets of symbols can be associated with the same or different symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols.

In FIG. 5A, the game display 500 depicts a plurality of symbol display areas (also referred to herein as symbol display positions) 510*a*, 510*b*, 510*c*, 510*d*, 510*e*, 510*f*, 510*g*, 510*h*, 510*i*, 510*j*, 510*k*, 5101, 510*m*, 510*n*, and 510*o*. These plurality of symbol display areas can be associated in a manner that provides the appearance of game reels. It should also be appreciated that the symbol display areas may not be associated with game reels in some implementations. As illustrated in FIG. 5A, symbol display areas 510*a*, 510*b*, 510*c*, 510*d*, 510*e*, 510*f*, 510*g*, 510*h*, 510*i*, 510*j*, 510*k*, 5101, 510*m*, 510*n*, and 510*o* are associated in a manner that provides the appearance of a set of five slot machine game reels. In some implementations, the plurality of symbol display areas that provide the appearance of five game reels may be arranged in a manner that visibly shows three symbol positions of each of the five game reels. For example, the symbol display areas 510*a*-510*o* are each associated with positions on reels 502*a*-502*e*, respectively. As shown in FIG. 5A, symbol display areas 510*a*, 510*f*, and 510*k* are associated with reel 502*a*; symbol display areas 510*b*, 510*g*, and 510*l* are associated with reel 502*b*; symbol display areas 510*c*, 510*h*, and 510*m* are associated with reel 502*c*; and symbol display areas 510*d*, 510*i*, and 510*n* are associated with reel 502*d*; and symbol display areas 510*e*, 510*j*, and 510*o* are associated with reel 502*e*. The arrangement illustrated in the implementation of FIG. 5A thus creates a visible display area of the reels 502*a*-502*e* comprising three visible symbol positions for each reel. When viewed together, reels 502*a*-502*e* appear like a 3-row by 5-column reel array in display 500. In other implementations, smaller or larger visible areas of the reels can be displayed. That is, the reels 502*a*-502*e* may show fewer or a larger number of visible symbol display areas. In some implementations, some symbol display areas can be hidden to hold generated symbols for use when the reels are nudged, as is discussed herein. While symbol display areas are illustrated with defined boxes, it should be appreciated that in some implementations, the defined boxes are not visible to the player. It should also be appreciated that in some implementations, the symbol display areas are other shapes or not defined shapes and may not be associated with reels.

Each reel 502*a*-502*e* may display a plurality of symbols that the gaming system generates from the sets of symbols in their respective symbol display areas as illustrated in FIG. 5A. In FIG. 5A, the gaming system is depicted as having generated stacked Ace symbols on reels 502*a*, 502*c*, and 502*e*. As noted above, the gaming system may evaluate the reels for stacked symbols and sandwiched reels. In FIG. 5A, the gaming system determined that reel 502*b* is a sandwiched reel between reels 502*a* and 502*c*, where reels 502*a* and 502*c* include matching stacked Ace symbols. Likewise, the gaming system determined that reel 502*d* is a sandwiched reel between reels 502*c* and 502*e*, where reels 502*c* and 502*e* also include matching stacked Ace symbols.

In some implementations, the gaming system may generate an overlay of different stacked symbols over reels 502*a*, 502*c*, and 502*e* (not shown) as discussed in connection with FIGS. 4A-4D. In some implementations, the gaming system does not generate the overlay of stacked symbols.

As shown in FIG. 5A, the gaming system caused the overlay of different stacked symbols over reels 502*a*, 502*c*, and 502*e* to crash into each other in directions shown with direction arrows 534, 536, 538, and 539. In some implementations, the gaming system generates an extra set of overlay stacked symbols over reel 502*c* so that enough overlay symbols can be used to crash into opposing reels with stacked symbols. The crashes results in explosions 530 and 532, which causes the gaming system to convert the symbols on reels 502*b* and 502*d* into different symbols. As shown in FIG. 5B, all of the displayed symbols are now Ace symbols. Thus, in some implementations. because stacked symbols were generated on more than two reels, the gaming system can convert symbols on more sandwiched reels and end up with matching symbols on all reels. It should be appreciated that such a conversion may result in maximum winning symbol combinations on all pay lines, delivering a substantial award to a player. In FIG. 5B, winning symbol combinations are shown on active pay lines 550*a*, 550*b*, and 550*c*. However, it should be appreciated that any suitable number of pay lines could have been active for award determination purposes.

Figure 6A:
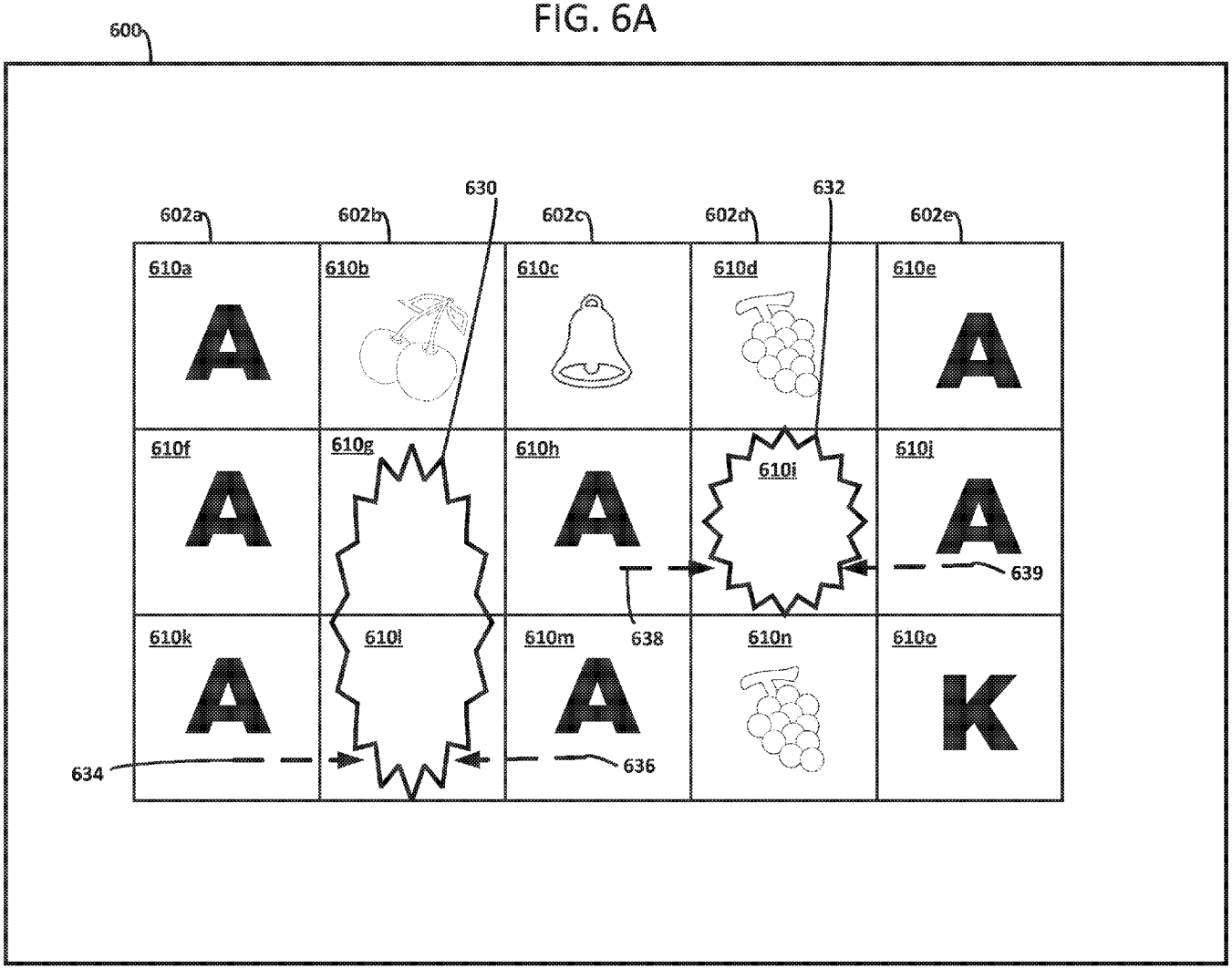
FIG. 6A shows a picture of a gaming system display illustrating an example symbol conversion based on stacked symbols in accordance with aspects of the present disclosure.
Figure 6B:
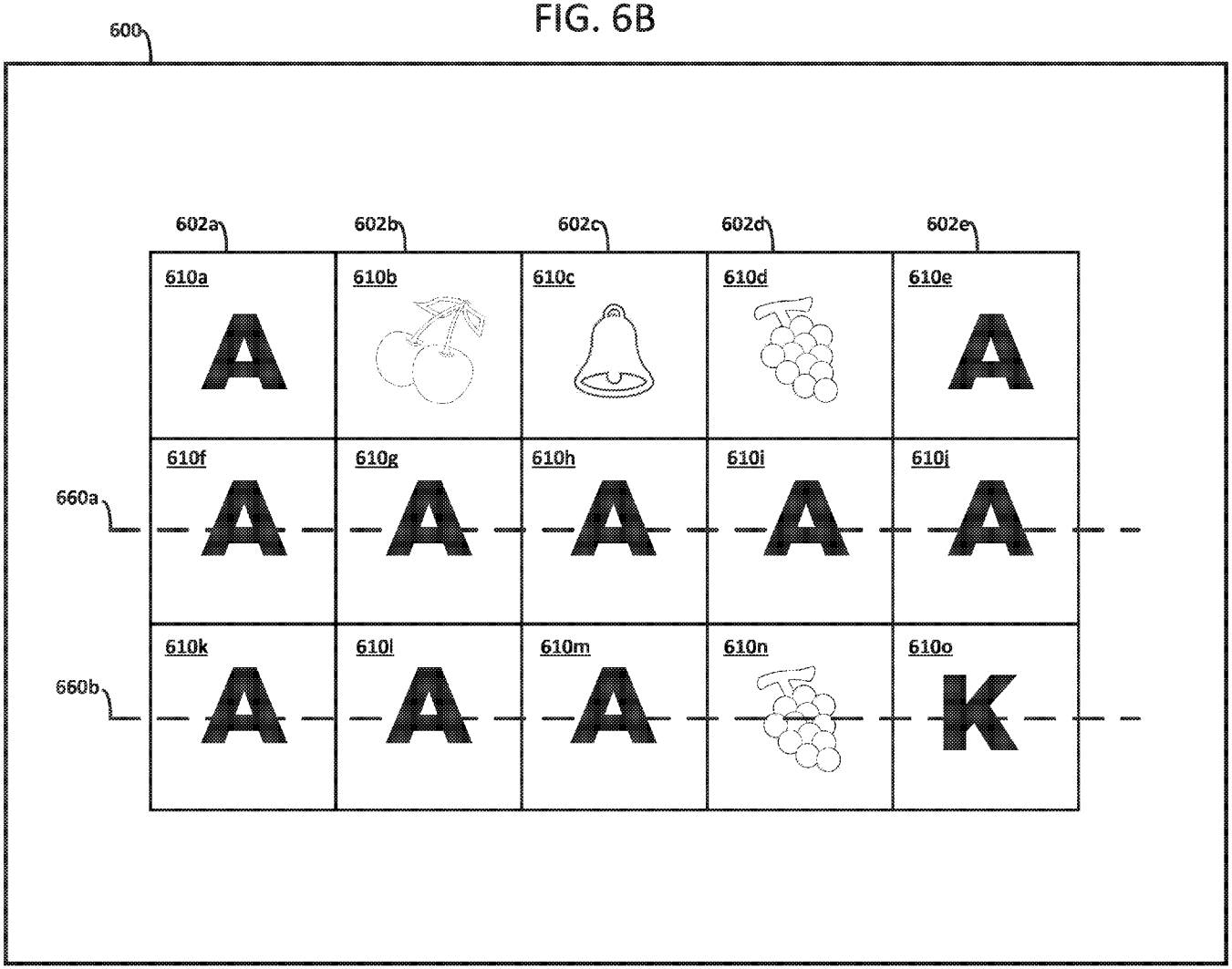
FIG. 6B shows a picture of a gaming system display illustrating an example symbol conversion based on stacked symbols in accordance with aspects of the present disclosure.

FIGS. 6A and 6B show pictures of a gaming system display illustrating another example symbol conversion based on stacked symbols in accordance with aspects of the present disclosure. For the sake of brevity, FIGS. 6A and 6B share features similar to the features already discussed above in connection with FIGS. 3A, 3B, and 4A-4D and such similar feature will not be described again. FIGS. 6A and 6B illustrate screen shots of one implementation of a gaming system converting symbols based on symbol stacks to obtain enhanced awards, where stacked symbols are generated on more than two reels, the symbol stacks include different quantities of symbols, and stacked symbol are not all horizontally aligned.

FIG. 6A illustrates one implementation of a game display 600 that the gaming system 100 may display on a display device of the gaming system. In some implementations, game display 600 may be displayed on first display 122 of gaming system 100 illustrated in FIG. 1. However, any other suitable display may be used. The game display 600 displays a set of virtual video slot machine reels 602*a*, 602*b*, 602*c*, 602*d*, and 602*e* as illustrated in FIG. 6A for a primary or base game. As also illustrated in FIG. 6A, the reels 602*a*-602*e* are displayed substantially side by side. It should be appreciated that reels 602*a*-602*e* can be displayed with any suitable amount of separation or no separation. It should be appreciated that the game shown in game display 600 is merely representative and may have more or fewer game elements (e.g., reels, symbol display areas, symbols, etc.) shown in the game display 600. It should also be appreciated that other games may be used for the primary or base game.

In some implementations, the reels 602*a*-602*e* are each respectively associated with a set of symbols or a symbol set, where each set of symbols includes a number of symbols. The sets of symbols can be associated with the same or different symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols.

In FIG. 6A, the game display 600 depicts a plurality of symbol display areas (also referred to herein as symbol display positions) 610*a*, 610*b*, 610*c*, 610*d*, 610*e*, 610*f*, 610*g*, 610*h*, 610*i*, 610*j*, 610*k*, 610*l*, 610*m*, 610*n*, and 610*o*. These plurality of symbol display areas can be associated in a manner that provides the appearance of game reels. It should also be appreciated that the symbol display areas may not be associated with game reels in some implementations. As illustrated in FIG. 6A, symbol display areas 610*a*, 610*b*, 610*c*, 610*d*, 610*e*, 610*f*, 610*g*, 610*h*, 610*i*, 610*j*, 610*k*, 6101, 610*m*, 610*n*, and 610*o* are associated in a manner that provides the appearance of a set of five slot machine game reels. In some implementations, the plurality of symbol display areas that provide the appearance of five game reels may be arranged in a manner that visibly shows three symbol positions of each of the five game reels. For example, the symbol display areas 610*a*-610*o* are each associated with positions on reels 602*a*-602*e*, respectively. As shown in FIG. 6A, symbol display areas 610*a*, 610*f*, and 610*k* are associated with reel 602*a*; symbol display areas 610*b*, 610*g*, and 610*l* are associated with reel 602*b*; symbol display areas 610*c*, 610*h*, and 610*m* are associated with reel 602*c*; and symbol display areas 610*d*, 610*i*, and 610*n* are associated with reel 602*d*; and symbol display areas 610*e*, 610*j*, and 610*o* are associated with reel 602*e*. The arrangement illustrated in the implementation of FIG. 6A thus creates a visible display area of the reels 602*a*-602*e* comprising three visible symbol positions for each reel. When viewed together, reels 602*a*-602*e* appear like a 3-row by 6-column reel array in display 600. In other implementations, smaller or larger visible areas of the reels can be displayed. That is, the reels 602*a*-602*e* may show fewer or a larger number of visible symbol display areas. In some implementations, some symbol display areas can be hidden to hold generated symbols for use when the reels are nudged, as is discussed herein. While symbol display areas are illustrated with defined boxes, it should be appreciated that in some implementations, the defined boxes are not visible to the player. It should also be appreciated that in some implementations, the symbol display areas are other shapes or not defined shapes and may not be associated with reels.

Each reel 602*a*-602*e* may display a plurality of symbols that the gaming system generates from the sets of symbols in their respective symbol display areas as illustrated in FIG. 6A. In FIG. 6A, the gaming system is depicted as having generated stacked Ace symbols on reels 602*a*, 602*c*, and 602*e*. In this implementation, a symbol stack can be formed from as few as two symbols on the same reels. The Ace symbol stack on reel 402*a* includes three Ace symbols. The Ace symbol stack on reel 402*c* includes two Ace symbols. The Ace symbol stack on reel 402*e* includes two Ace symbols.

As noted above, the gaming system may evaluate the reels for stacked symbols and sandwiched reels. In this implementation, as shown in FIG. 6A, the gaming system determined that reel 602*b* is a sandwiched reel between reels 602*a* and 602*c*, where reels 602*a* and 602*c* include a partial matching stack of Ace symbols. Likewise, the gaming system determined that reel 602*d* is a sandwiched reel between reels 602*c* and 602*e*, where reels 602*c* and 602*e* also include a partial matching stack of Ace symbols. For reels 602*c* and 602*e*, the stacked symbol match in a horizontally formed plane along symbol display areas 610*h* and

610*j*. In some implementations, the gaming system does not convert symbols on a sandwiched reel when the stacked symbols do not match in a horizontally formed plane along symbol display areas. However, in alternative implementations, the gaming system may convert the quantity of symbols on a sandwiched reel based on the quantity of matching symbols on surrounding reels regardless of whether the stacked symbols match in a horizontally formed plane along symbol display areas.

In some implementations, the gaming system may generate an overlay of different stacked symbols over reels 602*a*, 602*c*, and 602*e* (not shown). In some implementations, the gaming system does not generate the overlay.

As shown in FIG. 6A, the gaming system caused the overlay of different stacked symbols over reels 602*a*, 602*c*, and 602*e* to crash into each other in directions shown with direction arrows 634, 636, 638, and 639. In some implementations, the gaming system generates an extra set of overlay stacked symbols over reel 602*c* so that such enough overlay symbols can be used to crash into opposing reels with stacked symbols.

The crashes results in explosions 630 and 632, which causes the gaming system to convert some of the symbols on reels 602*b* and 602*d* into different symbols. As shown in FIG. 6A, the crashes cover fewer than all of the symbols in reels 602*b* and 602*d*. In some implementations, the crashes cover the symbols in reels 602*b* and 602*d* that are in the same horizontal plane as stacked symbols in the surrounding reels. For example, since the Bell symbol in symbol display area 610*c* was not part of the symbol stack in reel 602*c*, the gaming system does not create a crash over the Cherry symbol in symbol display area 610*b*.

As shown in FIG. 6B, the symbols in symbol display area 610*g*, 610*i*, and 610*l* were converted into Ace symbols. Thus, in some implementations, because stacked symbols were generated on more than two reels, the gaming system can convert symbols on more sandwiched reels, but restrict the conversion to symbols on a sandwiched reel that align in the same horizontal plane as stacked symbols on the surrounding reels. It should be appreciated that such a conversion results in enhanced winning symbol combinations over the originally generated and displayed symbols. In FIG. 6B, winning symbol combinations are shown on active pay lines 660*a* and 660*b*. However, it should be appreciated that any suitable number of pay lines could have been active for award determination purposes.

Based on the forgoing description, it should be appreciated that a gaming system and method with improvements to game outcomes by converting symbols in reels based on stacked symbols creates new and very exciting ways for a player to obtain improved winnings with a potential to earn greater awards. Such a potential to earn greater awards creates a greatly improved sense of anticipation for players.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." In addition, where features or aspects of the disclosure are described in terms of Markush groups, those skilled in the art will recognize that the disclosure is also thereby described in terms of any individual member or subgroup of members of the Markush group.

A number of implementations of the invention have been described. Various modifications may be made without departing from the spirit and scope of the invention. For example, various forms of the flows shown above may be used, with steps re-ordered, added, or removed. Accordingly, other implementations are within the scope of the following claims.

I claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via the input device, the credit balance being decreased by the wager;

randomly generate a plurality of symbols from a plurality of symbol sets;

display, on the display device, the plurality of symbols in a plurality of symbol display areas, where the plurality of symbol display areas are arranged in a plurality of columns;

determine that at least two of the plurality of columns include stacked symbols, where stacked symbols comprise at least two of a same symbol in adjacent symbols display areas of one of the plurality of columns;

determine that at least one of the plurality of columns is a sandwiched column, where the sandwiched column comprises one of the plurality of columns that is sandwiched between the at least two of the plurality of columns that include stacked symbols;

randomly generate a plurality of new stacked symbols for the at least two of the plurality of columns that include stacked symbols;

display the plurality of new stacked symbols;

convert, into a different symbol, at least one symbol in the sandwiched column based on the plurality of new stacked symbols;

display, on the display device, the different symbol;

evaluate the plurality of symbols that remain displayed and the different symbol for winning symbol combinations;

display, on the display device, an award based on any winning symbol combinations, the credit balance being increased by the award; and issue value from the value dispenser based on the credit balance upon receipt of a cash out signal.

2. The gaming system of claim 1, wherein the different symbol matches the symbols that comprise the stacked symbols.

3. The gaming system of claim 2, wherein the processor further converts a plurality of symbols in sandwiched columns into the different symbol, where the different symbol matches the stacked symbols, where a quantity of the converted plurality of symbols is based on the plurality of new stacked symbols.

4. The gaming system of claim 3, wherein after the processor further converts the plurality of symbols in the sandwiched columns into the different symbol, all displayed symbols are matching symbols.

5. The gaming system of claim 1, wherein the processor further converts, into different symbols, a plurality of sandwiched symbols in the sandwiched column.

6. The gaming system of claim 5, wherein the different symbols are matching symbols.

7. The gaming system of claim 1, wherein stacked symbols are predetermined symbols from the plurality of symbol sets.

8. The gaming system of claim 7, wherein the predetermined symbols are associated with a higher probability of being generated than other symbols from the plurality of symbol sets.

9. The gaming system of claim 7, wherein the predetermined symbols are associated with low value awards.

10. The gaming system of claim 1, wherein the processor further determines whether more than one column of the plurality of columns are sandwiched columns.

11. The gaming system of claim 10, wherein the processor further determines that at least three of the plurality of columns each include stacked symbols.

12. The gaming system of claim 11, wherein the processor further:

converts a first sandwiched column that is sandwiched between a pair of the three of the plurality of columns that include stacked symbols, and converts a second sandwiched column that is sandwiched between a different pair of the three of the plurality of columns that include stacked symbols.

13. The gaming system of claim 1, wherein when converting at least one symbol in the at least one sandwiched column into a different symbol, the processor determines whether the at least one symbol is in a symbol display area that is in the same horizontal plane as the stacked symbols.

14. The gaming system of claim 1, wherein stacked symbols further comprise all of the same symbol in adjacent symbols display areas of one of the plurality of columns.

15. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

randomly generating a plurality of symbols from a plurality of symbol sets;

displaying, on a display device of the housing, the plurality of symbols in a plurality of symbol display areas, where the plurality of symbol display areas are arranged in a plurality of columns;

determining, with the processor, that at least two of the plurality of columns include stacked symbols, where stacked symbols comprise at least two of a same symbol in adjacent symbols display areas of one of the plurality of columns;

determining that at least one of the plurality of columns is a sandwiched column, where the sandwiched column comprises one of the plurality of columns that is sandwiched between the at least two of the plurality of columns that include stacked symbols;

randomly generating a plurality of new stacked symbols for the at least two of the plurality of columns that include stacked symbols;

displaying the plurality of new stacked symbols;

converting, into a different symbol, at least one symbol in the sandwiched column based on the plurality of new stacked symbols;

displaying the different symbol;

evaluating the plurality of symbols that remain displayed and the different symbol for winning symbol combinations;

displaying, on the display device, an award based on any winning symbol combinations;

increasing, by the processor, the credit balance; and issuing another monetary value, by a value dispenser, based on the credit balance upon receipt of a cash out signal via.

16. The method of operating the gaming system of claim 15, wherein the different symbol matches the symbols that comprise the stacked symbols.

17. The method of operating the gaming system of claim 15, wherein the processor further converts, into different symbols, a plurality of sandwiched symbols in the sandwiched column.

18. The method of operating the gaming system of claim 17, wherein the different symbols are matching symbols.

19. The method of operating the gaming system of claim 15, wherein stacked symbols are predetermined symbols from the plurality of symbol sets.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

randomly generate a plurality of symbols from a plurality of symbol sets;

display, on the display device, the plurality of symbols in a plurality of symbol display areas, where the plurality of symbol display areas are arranged in a plurality of columns;

determine that at least two of the plurality of columns include stacked symbols, where stacked symbols comprise at least two of a same symbol in adjacent symbols display areas of one of the plurality of columns;

determine that at least one of the plurality of columns is a sandwiched column, where the sandwiched column comprises one of the plurality of columns that is sandwiched between the at least two of the plurality of columns that include stacked symbols;

randomly generate a plurality of new stacked symbols for the at least two of the plurality of columns that include stacked symbols;

display the plurality of new stacked symbols;

convert, into a different symbol, at least one symbol in the sandwiched column based on the plurality of new stacked symbols;

display the different symbol;

evaluate the plurality of symbols that remain displayed and the different symbol for winning symbol combinations;

display, on the display device, an award based on any winning symbol combinations, the credit balance being increased by the award; and issue value from a value dispenser based on the credit balance upon receipt of a cash out signal.

* * * * *